US006334555B1

(12) United States Patent
Randall et al.

(10) Patent No.: US 6,334,555 B1
(45) Date of Patent: Jan. 1, 2002

(54) FITMENT AND RESEALABLE DISPENSING CLOSURE ASSEMBLY FOR HIGH-PRESSURE SEALING AND BI-MODAL DISPENSING

(75) Inventors: Jeffrey T. Randall, Oconomowoc; Kelly A. Smith, Troy; Corinne M. Blomdahl, Muskego, all of WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/811,098

(22) Filed: Mar. 16, 2001

Related U.S. Application Data

(63) Continuation-in-part of application No. 09/579,323, filed on May 25, 2000.

(51) Int. Cl.[7] ..... B67D 3/00
(52) U.S. Cl. ..... 222/521
(58) Field of Search ..... 226/212, 213, 226/494, 520, 521, 519, 553, 549, 556, 546

(56) References Cited

U.S. PATENT DOCUMENTS

| | | | | |
|---|---|---|---|---|
| 2,759,643 A | | 8/1956 | Dahlin | |
| 2,808,169 A | | 10/1957 | Gruber | |
| 3,010,619 A | * | 11/1961 | Gronemeyer et al. | 222/521 |
| 3,123,259 A | | 3/1964 | Musel et al. | |
| 3,194,453 A | | 7/1965 | Cherba | |
| 3,273,754 A | | 9/1966 | Lindley | |
| 3,297,212 A | | 1/1967 | Neuner | |
| 3,887,116 A | * | 6/1975 | Ishikawa et al. | 222/520 |
| 3,901,410 A | | 8/1975 | Schultz | |
| 4,506,809 A | | 3/1985 | Corsette | |

(List continued on next page.)

FOREIGN PATENT DOCUMENTS

EP 0 759 876 B1 11/1995

OTHER PUBLICATIONS

U.S. Patent Application Ser. No. 09/157,706, filed Sep. 21, 1998.

U.S. Patent Application Ser. No. 09/502,630, filed Feb. 11, 2000.

(List continued on next page.)

*Primary Examiner*—David A. Scherbel
*Assistant Examiner*—Thach H Bui
(74) *Attorney, Agent, or Firm*—Rockey, Milnamow & Katz, Ltd.

(57) ABSTRACT

A fitment is provided for incorporation into a closure assembly to provide at least one high-pressure seal suitable for maintaining high-positive pressures in a container having pressurized contents, such as carbonated beverages. The fitment and closure assembly also provide for bi-modal dispensing operations, because the fitment it can be removed from the closure assembly to provide alternative flow characteristics from the container through the closure assembly. The fitment may also be provided with one or more projections adapted to engage a thread on the closure body such that rotation of the closure body relative to the container results in removal of the fitment from the container. The fitment may also be provided with one or more projections for engaging the closure body to limit its movement relative to the container, thereby defining a fully open dispensing position of the closure body. The projection(s) preferably take the form of a plurality of radially extending ratchet shaped projections or the form of a single, helical flange extending around a peripheral surface of the fitment. A closure assembly incorporating the fitment also may include a plurality of seals formed between various features on the fitment and the closure body, which may include a hinged lid, to enhance the sealing characteristics of the closure assembly.

30 Claims, 27 Drawing Sheets

U.S. PATENT DOCUMENTS

| | | | | | |
|---|---|---|---|---|---|
| 4,561,570 | A | | 12/1985 | Zulauf et al. | |
| 4,569,456 | A | | 2/1986 | Weiler et al. | |
| 4,690,304 | A | | 9/1987 | Morel | |
| 4,785,978 | A | | 11/1988 | Kano et al. | |
| 4,805,807 | A | | 2/1989 | Perne et al. | |
| 4,867,354 | A | | 9/1989 | Schreiber | |
| 4,941,598 | A | | 7/1990 | Lambelet et al. | |
| 5,104,008 | A | * | 4/1992 | Crisci | 222/521 |
| 5,111,949 | A | | 5/1992 | Ambrosi et al. | |
| 5,111,977 | A | | 5/1992 | Maquire et al. | |
| 5,125,539 | A | | 6/1992 | Schneider | |
| 5,145,083 | A | | 9/1992 | Takahashi | |
| 5,145,094 | A | | 9/1992 | Perimutter | |
| 5,267,673 | A | | 12/1993 | Crosnier et al. | |
| 5,295,597 | A | | 3/1994 | Green | |
| 5,325,999 | A | | 7/1994 | Gueret | |
| 5,377,873 | A | | 1/1995 | Minnette | |
| 5,421,487 | A | | 6/1995 | Moretti | |
| 5,431,305 | A | | 7/1995 | Kaminski | |
| 5,456,374 | A | | 10/1995 | Beck | |
| 5,562,220 | A | | 10/1996 | Favre | |
| 5,680,969 | A | | 10/1997 | Gross | |
| 5,692,651 | A | | 12/1997 | Fuchs | |
| 5,743,444 | A | * | 4/1998 | Beck et al. | 222/521 |
| 5,772,076 | A | | 6/1998 | Juk et al. | |
| 5,810,185 | A | | 9/1998 | Groesbeck | |
| 5,938,086 | A | | 8/1999 | Gross | |
| 6,024,256 | A | * | 2/2000 | Beck et al. | 222/521 |
| 6,039,218 | A | | 3/2000 | Beck | |
| 6,059,132 | A | | 5/2000 | Benjamin | |
| 6,062,441 | A | | 5/2000 | Mengen et al. | |
| 6,065,648 | A | | 5/2000 | Tauber | |
| 6,095,382 | A | * | 8/2000 | Gross | 222/520 |

OTHER PUBLICATIONS

U.S. Patent Application Ser. No. 09/550,279, filed Apr. 14, 2000.

Photographs A–1 and A–2.

Photographs B–1, B–2, B–3, B–4, B–5, and B–6.

* cited by examiner

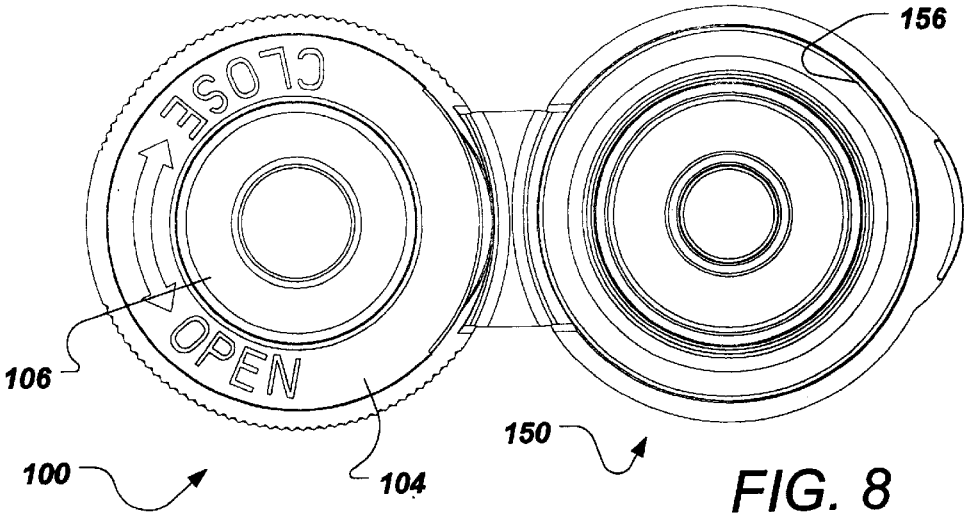
FIG. 8
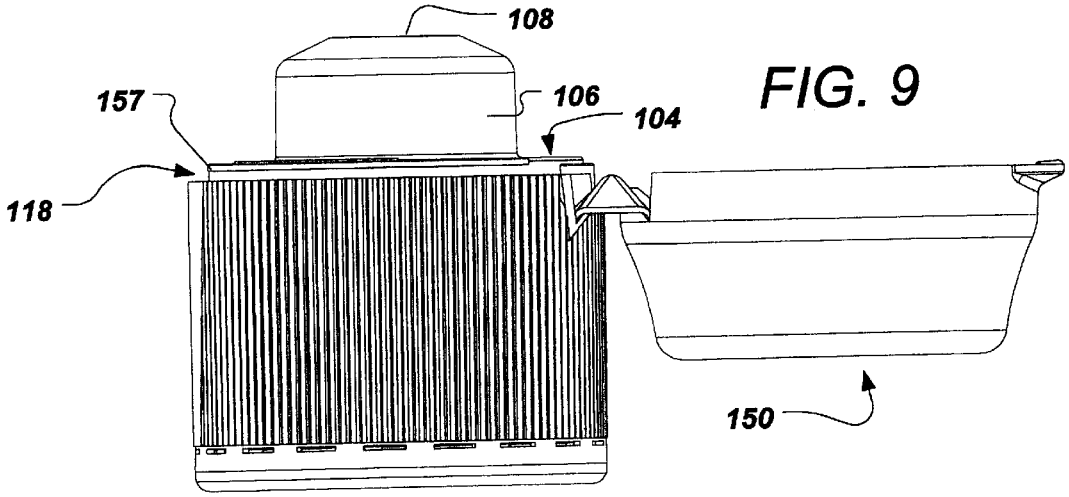
FIG. 9
FIG. 10
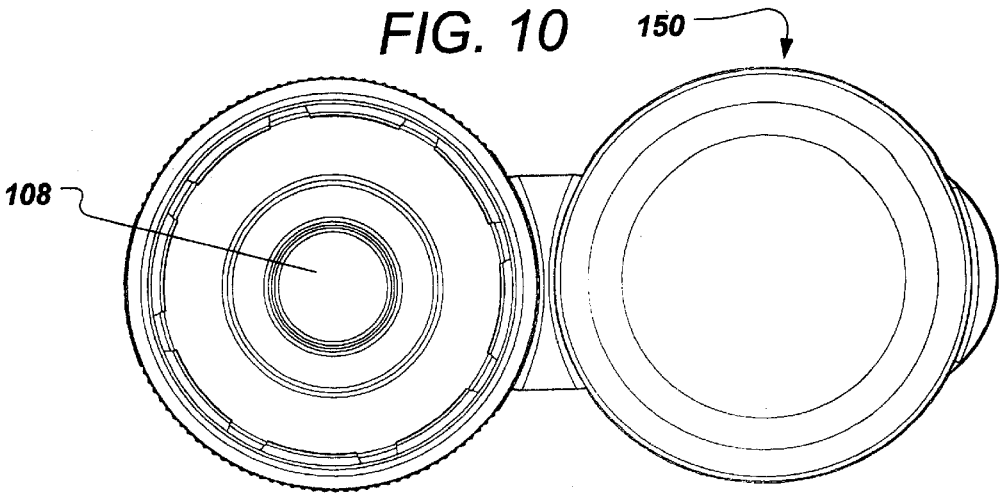

608
611
610
606
600
607
603
642
635
633
625
613
40
40

FITMENT AND RESEALABLE DISPENSING CLOSURE ASSEMBLY FOR HIGH-PRESSURE SEALING AND BI-MODAL DISPENSING

CROSS REFERENCE TO RELATED APPLICATION

This application is a continuation-in-part of U.S. patent application Ser. No. 09/579,323, filed on May 25, 2000, the subject matter and entire writing of which is incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The invention relates to fitments for use in resealable dispensing closure assemblies to provide high-pressure sealing, to provide two or more dispensing modes and to control the movement of closure bodies in such closure assemblies. The invention also relates to resealable dispensing closure assemblies that incorporate such fitments and to tamper-evident features for closure assemblies.

BACKGROUND OF THE INVENTION AND TECHNICAL PROBLEMS POSED BY THE PRIOR ART

Closure assemblies that are used on containers for pressurized contents, such as carbonated beverages, must be able to maintain a sealed condition even when subject to high internal pressures, which are typically 50 p.s.i.g. but which may, under some ambient conditions, exceed 100 p.s.i.g. High internal pressures may also be present in containers which contain non-carbonated beverages. For example, bottled water is often provided with a nitrogen charge in order to provide a positive internal pressure on the container to increase container strength and structural stability during shipping.

Known closure assemblies for containers for pressurized contents are characterized by several disadvantages. For example, such closures, which typically include a threaded aluminum or plastic cap, must be completely removed from the container to dispense the contents and must be threaded completely back onto the container to reseal it. Since the closure cap is detached from the container during dispensing, there is potential for the closure cap to become contaminated or misplaced. Thus, it would be advantageous to provide a closure assembly which addresses this shortcoming in the prior art.

Another disadvantage associated with known closure assemblies for containers for pressurized contents is that such closure assemblies offer only one dispensing mode wherein the closure cap is entirely removed from the container and the product is poured directly through the container opening. This sole dispensing mode may be inconvenient for certain users. Consider an elderly or very young person of limited strength who is attempting to dispense a beverage from a large container, such as a 2-liter bottle, when it is full. Because they cannot support the entire weight of the container, the limited-strength user may tilt the container on a counter top and attempt to slowly pour the contents out. Since the entire closure is removed and the product will be dispensed in a relatively uncontrolled manner through the container opening, the product is likely to be spilled and wasted. It would therefore be desirable to provide a restricted flow closure assembly that offers a dispensing mode which provides more controlled dispensing of product than do prior art systems. On the other hand, other stronger users, who would like to pour the contents from the container at a faster rate, might find such a restricted flow closure assembly to be undesirable because the product cannot be dispensed quickly. It would therefore be further desirable to provide a resealable closure assembly that can be readily adapted to two or more dispensing modes and accommodate the dispensing preferences of a variety of users.

While resealable closures are generally known, and while it would be desirable to provide a resealable closure for containers of pressurized contents, there has not been widespread adoption of resealable closures in this area of the art. One reason for this is that, in general, resealable closures are relatively complicated and expensive to manufacture compared to the simple aluminum and plastic threaded cap closures of the prior art. Moreover, prior art resealable closures are typically not designed for use with pressurized contents.

Such prior art closures typically include a closure body that is threaded onto the container, and a spout engaging a separate set of threads on the closure body and rotatable relative to the closure body. The spout includes a dispensing orifice at its top and moves to an elevated position when rotated, moving the dispensing orifice from a sealing surface on the closure body and permitting flow of product.

Such known resealable closures have been widely adopted in containers for certain contents, such as shampoo or food condiments, but they have generally not been recognized as feasible or economical for pressurized content applications such as containers for carbonated beverages or non-carbonated liquids. The resealable closures of the prior art are usually costly because they incorporate relatively large numbers of parts and complex threaded features and molding techniques. For example, the closure body must be molded with two threaded portions: one threaded portion for securing the closure to the container finish and another threaded portion for securing the spout to the closure body. These aspects of the prior art, coupled with the perceived increased costs in adapting known resealable closures to high-pressure containers, have fostered a reluctance in the art to attempt to provide resealable closures in such applications. It would therefore be desirable to provide a resealable closure that is suitable for high-pressure applications and which may be manufactured economically.

Resealable closures also present a challenge in design with regard to tamper-evidence features. Known resealable closures typically incorporate two tamper-evident features, such as frangible members, one for evidencing tampering with the closure body relative to the container and another for evidencing tampering of the spout relative to the closure body. These features increase the manufacturing complexity and material and manufacturing cost of known resealable closures. It would therefore be desirable to provide a resealable closure which has improved tamper-evidence features compared to known prior art devices.

BRIEF SUMMARY OF THE INVENTION

According to one aspect, the invention provides a fitment that may be incorporated into a closure assembly that provides a re-sealable dispensing capabilities and at least one high-pressure seal. As used herein, the term "high-pressure" is intended to refer to positive pressures that are typically associated with carbonated beverages and other pressurized products, which pressures are typically in the range of 50 to 100 p.s.i.g. Also, as used herein, the term "closure assembly" refers to a combination of sub-parts, which typically include a fitment and a closure body, and which could include other components such as a lid. The term "finish" is intended to refer to features on the exterior surface of a container, including features for attaching a closure assembly thereto and may include one or more threads, one or more snap-fit features or a threadless, smooth sliding finish for sliding attachment of a closure assembly.

Exemplary fitments and closure assemblies which embody this aspect of the invention include a fitment with a plug seal and a sealing post extending in a direction generally opposite the plug seal. The plug seal is adapted to engage an interior surface of a container to provide a high-pressure seal. The plug seal may include one or more snap-fit beads or snap rings which engage respective snap grooves formed on the container interior surface. The fitment sealing post has a fitment sealing surface that is adapted to engage a sealing surface around a dispensing orifice formed in a spout of a closure body that cooperates with the fitment.

In a preferred form, the fitment includes a deck, and the plug seal extends below the deck, whereas the sealing post extends above the deck. One or more apertures are preferably formed in the fitment deck to permit fluid flow from the interior of the container through the fitment. A user may move the closure body vertically relative to the fitment to bring the closure body orifice sealing surface into or out of engagement with the fitment sealing surface, thereby closing or opening the orifice. Preferably, this provides a high-pressure seal between the dispensing orifice and the fitment sealing surface.

One advantage provided by this aspect of the invention is that the resealable closure assembly, owing to the high-pressure seal formed between the fitment and the container, can withstand high internal pressures. Another advantage is that the fitment remains in place, maintaining the high-pressure seal, even during movement of the closure body. This feature eliminates the need for the closure body to maintain a high-pressure seal directly with the container. Rather, the closure body need only maintain a high-pressure seal with the fitment. This permits the closure body to be of a simplified form. For example, since the high-pressure seal is maintained by the fitment, the closure body may cooperate with the container finish via threads or a telescoping connection and may function as a closure cap, to secure the closure assembly to the container, and as a movable spout, the actuation of which functions to open and close the dispensing orifice. Thus, the manufacture and operation of the closure assembly is simplified since the closure assembly does not require a separate spout or nozzle, as is employed in some prior art designs, to provide for resealability. Moreover, since the invention eliminates the need for a second thread, and a separate movable spout or nozzle cooperating with a second thread, there is no need for a second tamper-evidence feature on the closure assembly. Rather, a single tamper-evidence drop ring may be provided on the closure assembly to detect tampering with the closure body.

According to another feature of the invention, the fitment is provided in a closure assembly which is easily reconfigured into at least two dispensing modes. In a first dispensing mode, the fitment is installed on the container and secured thereto by a plug seal that engages the interior surface of the neck of the container. A closure body, including a spout and a dispensing orifice, is mounted over the fitment to the container finish, preferably by one or more threads that engage a like number of threads on the container finish. The fitment is provided with one or more apertures, preferably sized to provide flow limiting characteristics. In the first dispensing mode, the fitment limits flow from the container through a dispensing orifice in the closure body. In a second dispensing mode, the closure body and fitment are removed from the container, and the closure body is reinstalled on the container without the fitment. Dispensing occurs through the dispensing orifice in the closure body without product flow being limited by the fitment. This feature of the invention permits certain users, who might be of limited strength or have difficulty managing dispensing of contents, to configure the closure assembly in a first dispensing mode where controlled, limited flow occurs through the fitment. The feature also permits other users who might not desire the limitations imposed on dispensing by the fitment, to remove the closure body, remove the fitment and then replace the closure body to configure the closure assembly in a second dispensing mode.

According to yet another feature of the invention, the fitment is provided with features that make it easy to remove from the container. In an exemplary embodiment, the fitment includes at least one projection extending radially outward from the fitment and adapted to engage a thread or other component on a closure body. As the closure body is rotated and therefore elevated with respect to the container finish, the closure body thread engages the at least one projection, thereby lifting the fitment from the container. Continued rotation of the closure body results in removal of the closure body and fitment from the container. The closure body can be reinstalled, if desired. This aspect of the invention permits a user to easily remove the fitment by simple rotation of the closure body in order to adopt the closure assembly to the second dispensing mode, or to provide for unobstructed flow of contents from the container without the fitment or closure body installed.

According to another aspect, the invention provides a fitment with features that interact with a closure body to provide for limiting the vertical movement of the closure body to define a fully open dispensing position. In a preferred embodiment, the fitment is provided at least one fitment projection that extends radially outward from the fitment and is adapted to engage a closure body projection extending radially inward from a skirt on the closure body. The fitment also includes a fitment sealing surface that seals a dispensing orifice formed in a spout of the closure body. The closure body is threadably fastened to the container. As the closure body is rotated and unscrewed from the container, the closure body, and therefore the dispensing orifice, elevate relative to the fitment sealing surface, providing a passage for product. Continued rotation of the closure body brings the closure body projection into engagement with the fitment projection to significantly increase resistance to further rotation of the closure body, thereby defining a fully open dispensing position providing a predetermined clearance between the dispensing orifice and the fitment sealing surface.

According to yet another aspect of the invention, a closure assembly is provided which includes several sealing interfaces that provide enhanced high-pressure sealing capabilities compared to the prior art. An exemplary closure assembly embodying this aspect of the invention includes a fitment having a fitment deck and a plug seal with a sealing bead formed thereon extending from the fitment deck. The plug seal provides a first seal, which is a high-pressure seal, with an interior surface of a container. The fitment includes a sealing post and an annular fitment sealing collar, both extending from the fitment deck in a generally opposite direction to the plug seal. The annular sealing collar includes a sealing bead on its periphery. At least one aperture is provided through the fitment deck in an area between the sealing post and the annular sealing collar to permit passage of the container contents through the fitment.

In accordance with this aspect of the invention, the exemplary closure assembly also includes a closure body that is provided with an annular closure body skirt having at least one thread that engages a like number of threads formed in the container neck finish. The closure body also includes a closure deck and a generally cylindrical spout extending upward therefrom. The spout also includes a dispensing orifice having an annular sealing collar extending therefrom. The annular sealing collar is adapted to engage the fitment sealing post to provide a second seal, which is a high-pressure seal, when the closure body is in a closed position. The spout includes an interior surface that provides a third seal, which is a dynamic, high-pressure seal, with the sealing bead of the annular fitment sealing collar.

Also in accordance with this aspect of the invention, the closure body is also provided with a lid, preferably hingedly connected to the body, which provides three or more additional seals. The closure body lid includes an inner "spud" which engages an exterior, peripheral surface of the dispensing orifice to provide a fourth seal. The closure body lid also includes an annular spout-engaging seal collar which has a sealing bead that engages a peripheral surface of the spout to provide a fifth seal. A sixth seal is provided between the closure body lid and the closure deck by peripheral shoulder formed on the closure deck and adapted to receive the lid skirt. The peripheral shoulder may include a snap-fit sealing groove which receives a complementarily-shaped snap-fit sealing bead formed on the closure body lid skirt. This aspect of the invention thus provides at least three high-pressure seals and at least three other seals in a compact closure assembly configuration useful for maintaining container contents under high-pressures.

In accordance with yet another feature of the invention, the resealable dispensing closure assembly may be resealed after the closure body has been moved to a dispensing position and without further movement of the closure body relative to the container. A method of resealing a closure assembly according to this aspect of the invention comprises moving the closure body from the closed position, in which the dispensing orifice is occluded by the fitment, to an open position, in which flow from the container through the dispensing orifice is permitted; and moving the lid to a closed position in which the lid occludes the dispensing orifice. This feature of the invention provides the advantage of permitting easy resealing of the closure assembly by pivoting or placing the lid on the closure body, without requiring the user to exert the effort required for moving the closure body relative to the container and fitment.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 8 is a top view of an exemplary closure body according to a preferred embodiment of the invention, shown with the closure cap in an open position;

FIG. 9 is a side elevational view of the exemplary closure body of FIG. 8;

FIG. 10 is a bottom view of the exemplary closure body of FIG. 8;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se illustrated in the figures and described herein forms no part of and therefore is not intended to limit the present invention. It will also be understood by those of ordinary skill that novel and non-obvious inventive aspects are embodied in the described exemplary fitment, alone, and in the combination of the exemplary fitment with the described exemplary closure body.

Figure 1:
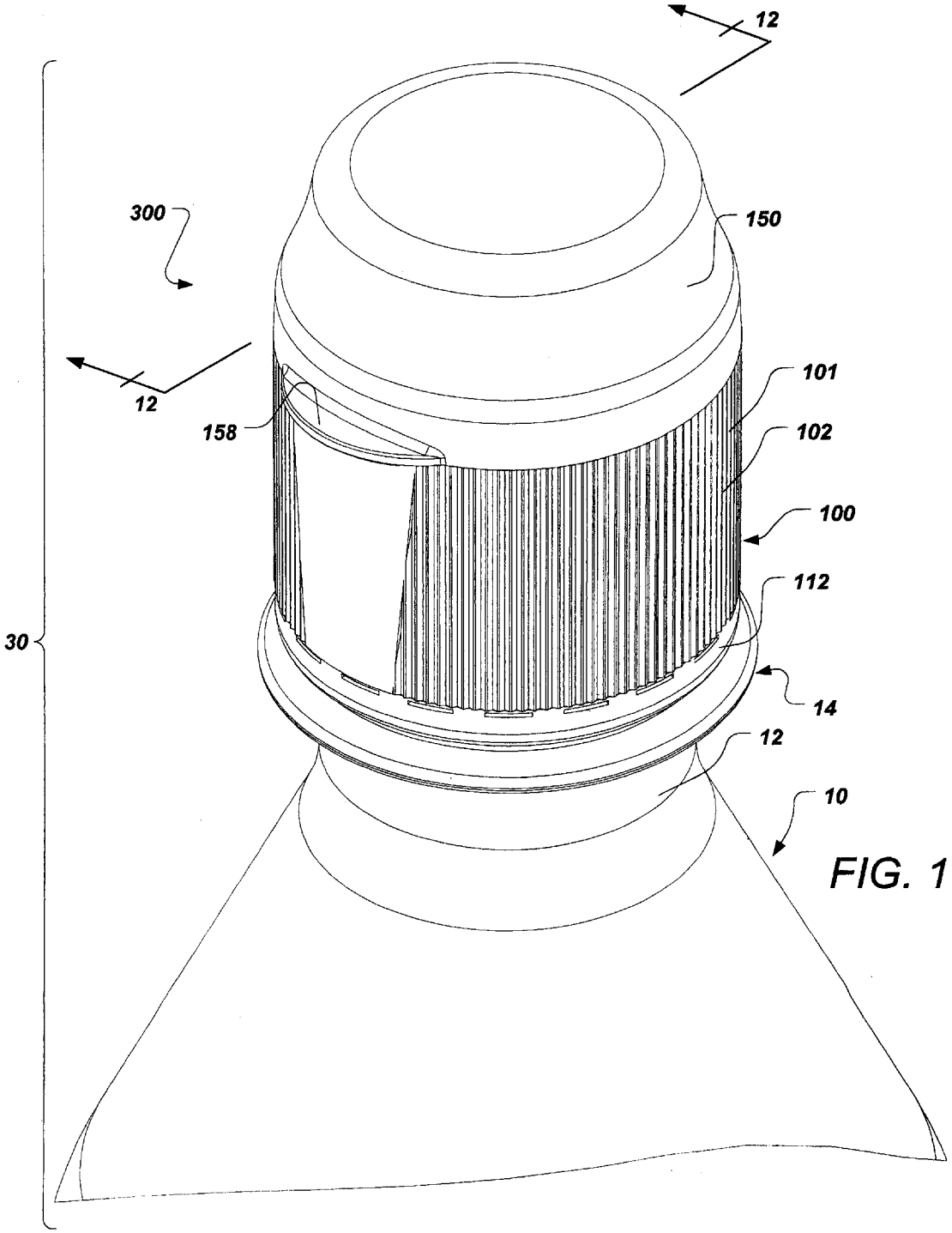
FIG. 1 is a perspective view of an exemplary dispensing closure assembly according to a preferred embodiment of the invention in a closed, pre-tamper position and installed on an exemplary container, which container forms no part of the invention.

Referring to FIG. 1, an exemplary dispensing closure assembly, generally referenced 300, is threadably attached to a container 10. The closure assembly 300 is shown as part of a package 30 that includes the closure assembly 300 and a container 10. The container 10 includes a container neck 12. This general container or bottle structure is well-known in the art. The container 10 may be rigid or somewhat flexible. It will be understood that the fitment and closure body of the invention are applicable to a wide variety of container structures and the illustrated and described container 10 merely provides an example. The closure assembly 300 and container 10 form the package 30.

The dispensing closure assembly 300 is illustrated in a closed, pre-tamper position in which an optional tamper-evident band or ring 112 is secured to a retaining flange 20 (FIG. 12) and unbroken. Tamper-evident band 112 may be of any suitable conventional or special design, the details of which form no part of the present invention. The band 112 typically is frangibly connected to the closure body 100 in a conventional manner, for example, using a frangible connecting web or bridges 114 that attach the tamper-evident band 112 at intermittent locations around the circumference of the closure body 100. Typically, the band 112 and the closure body 100 would be molded together from a thermoplastic material as a unitary structure.

Figure 2:
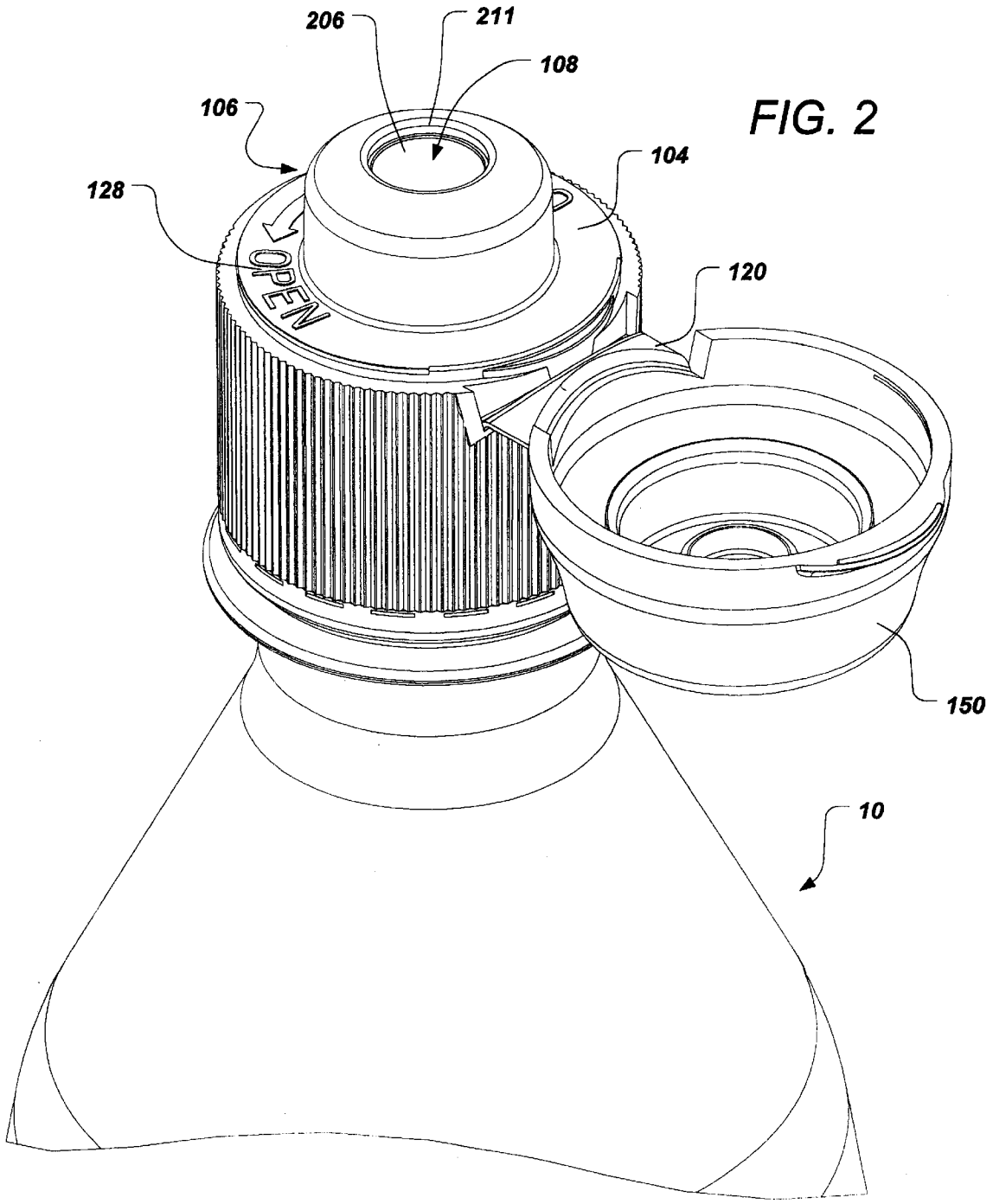
FIG. 2 is a perspective view of the exemplary dispensing closure assembly of FIG. 1, illustrated with the closure body cap in an open position and the closure body in a closed position.

The closure body 100 includes a closure body skirt 102 having a ribbed gripping surface 101 formed therein, and a closure lid 150 connected thereto by a hinge 120 (FIG. 2). A thumb lift 158 projects from the closure lid 150 for permitting a user to flip open the closure lid 150 by exerting an upward force on the bottom of the thumb lift 158. The dispensing closure body 100 is preferably molded together with the lid 150 from a thermoplastic material, such as polypropylene, to form a unitary structure. In an alternate embodiment, the lid 150 may be a separate lid that is not hingedly attached, or the lid may be omitted altogether. The particular material or materials from which the components are molded form no part of the present invention.

FIG. 2 illustrates the closure body lid 150 in an open position, exposing a spout 106 extending from the closure body deck 104. Closure body lid 150 is connected to the closure body 100 by a hinge 120, which is preferably integrally formed with the closure body 100 and closure body lid 150 and which may be a snap-action biased hinge or non-biased hinge formed according to a number of conventional and known techniques, the details of which are not necessary for an understanding of the invention. The illustrated hinge 120 is described in detail in the U.S. Pat.

No. 5,642,824 and is a bi-stable, snap-action hinge which advantageously can hold the lid 150 in the open position to facilitate dispensing of the contents from the package.

Figure 11:
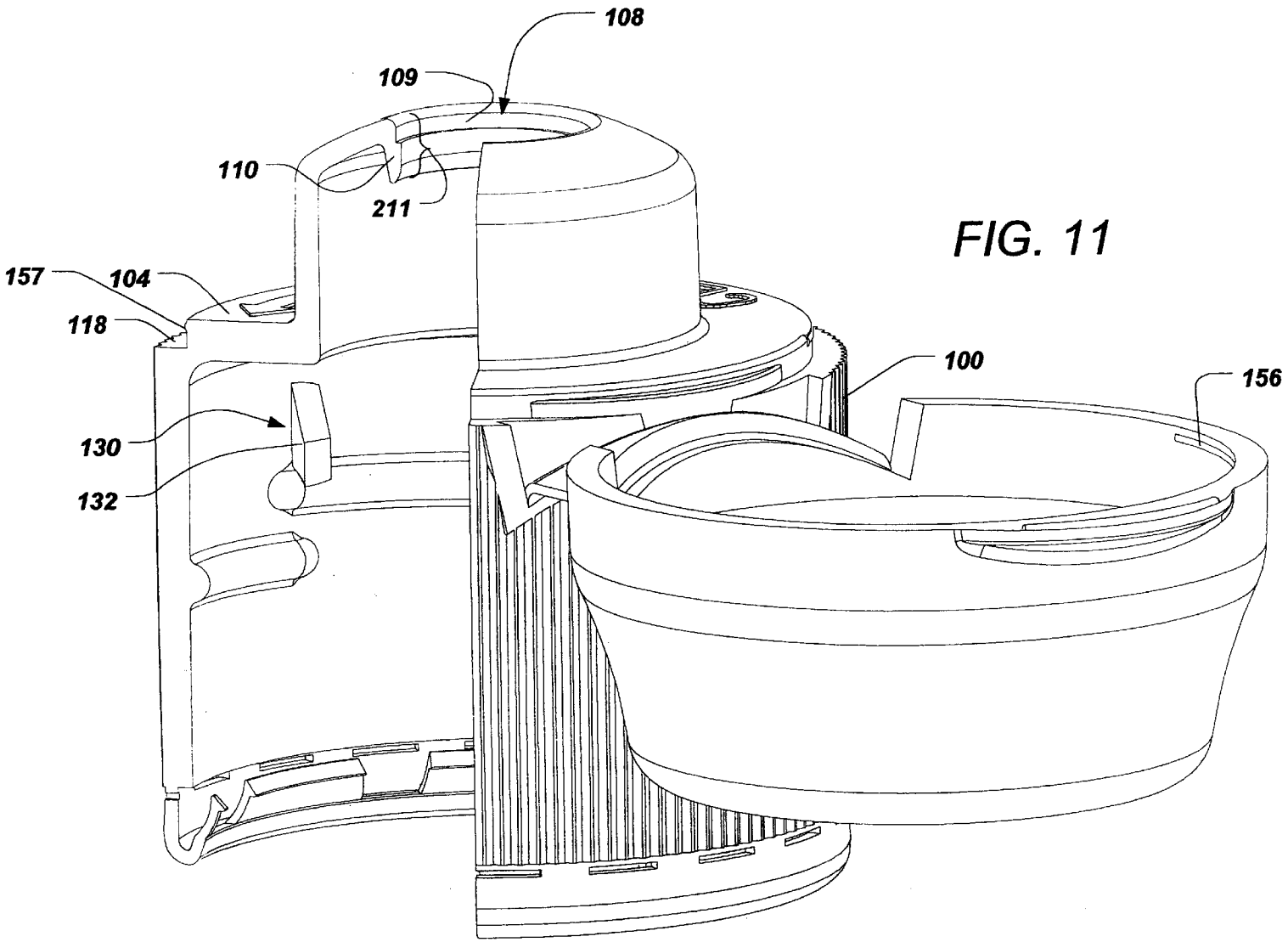
FIG. 11 is a perspective, cutaway view of the exemplary closure body of FIG. 8, illustrating an exemplary limiting projection according to a preferred embodiment of the invention.

Spout 106 is provided with an annular sealing sleeve 110 around a dispensing orifice 108 defined by a dispensing orifice peripheral sealing surface 211 on the sleeve 110 as shown in FIG. 11. The orifice 108 is normally closed or occluded by a fitment sealing post 206 (FIGS. 2 and 12), the details of which will be explained below. Closure body lid 150 is shown in an open position and closure body 100 is shown in a closed position in which passage of fluid through the dispensing orifice 108 is prevented. Indicia 128 (FIG. 2) may be provided on the closure body deck 104 to indicate to a user the opening and closing rotational directions for moving the closure body 100 relative to the container 10.

Figure 3:
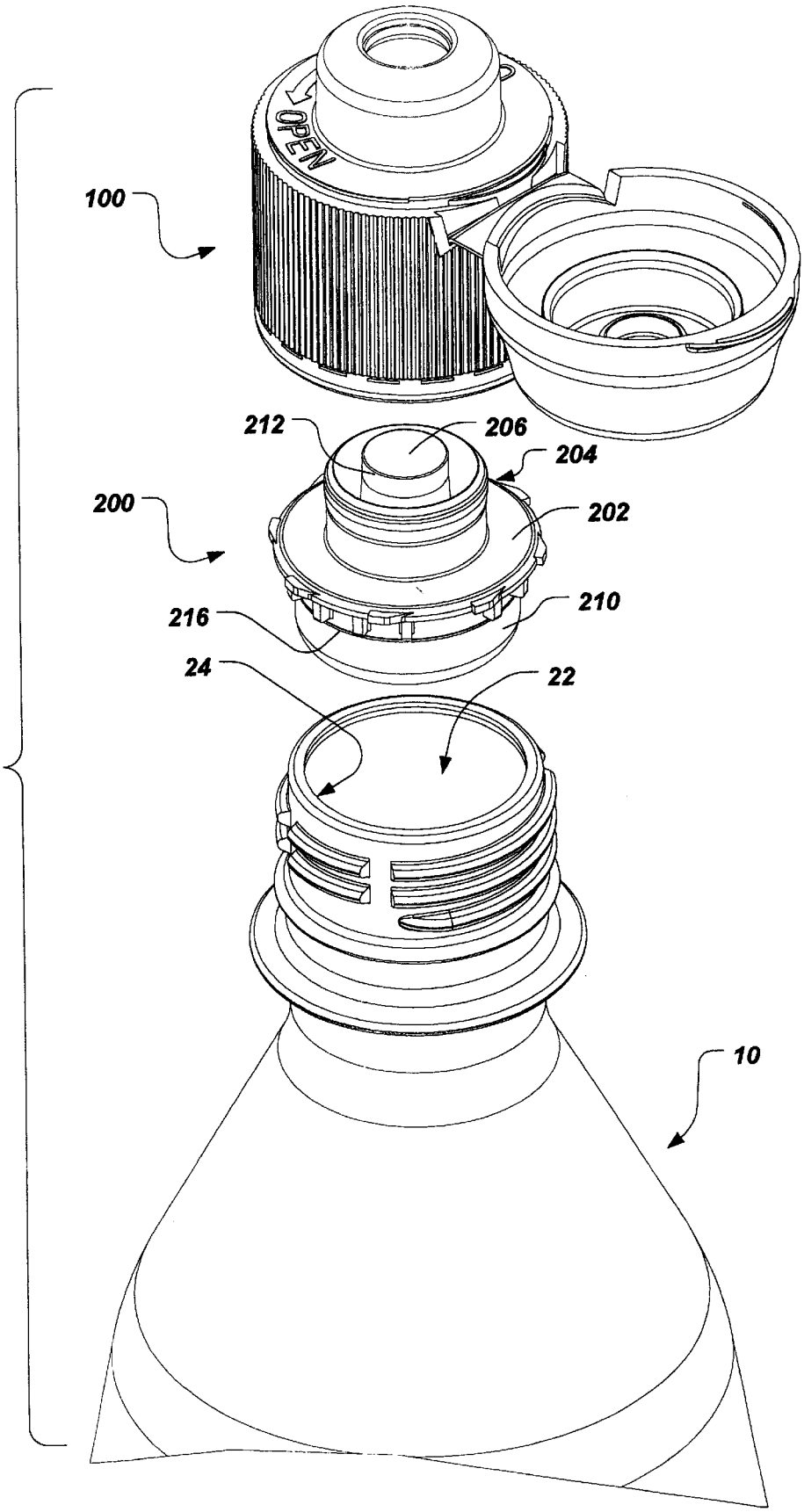
FIG. 3 is an exploded, perspective view of the exemplary dispensing closure assembly of FIG. 1 showing the closure body and an exemplary fitment prior to installation on the container.
Figure 12:
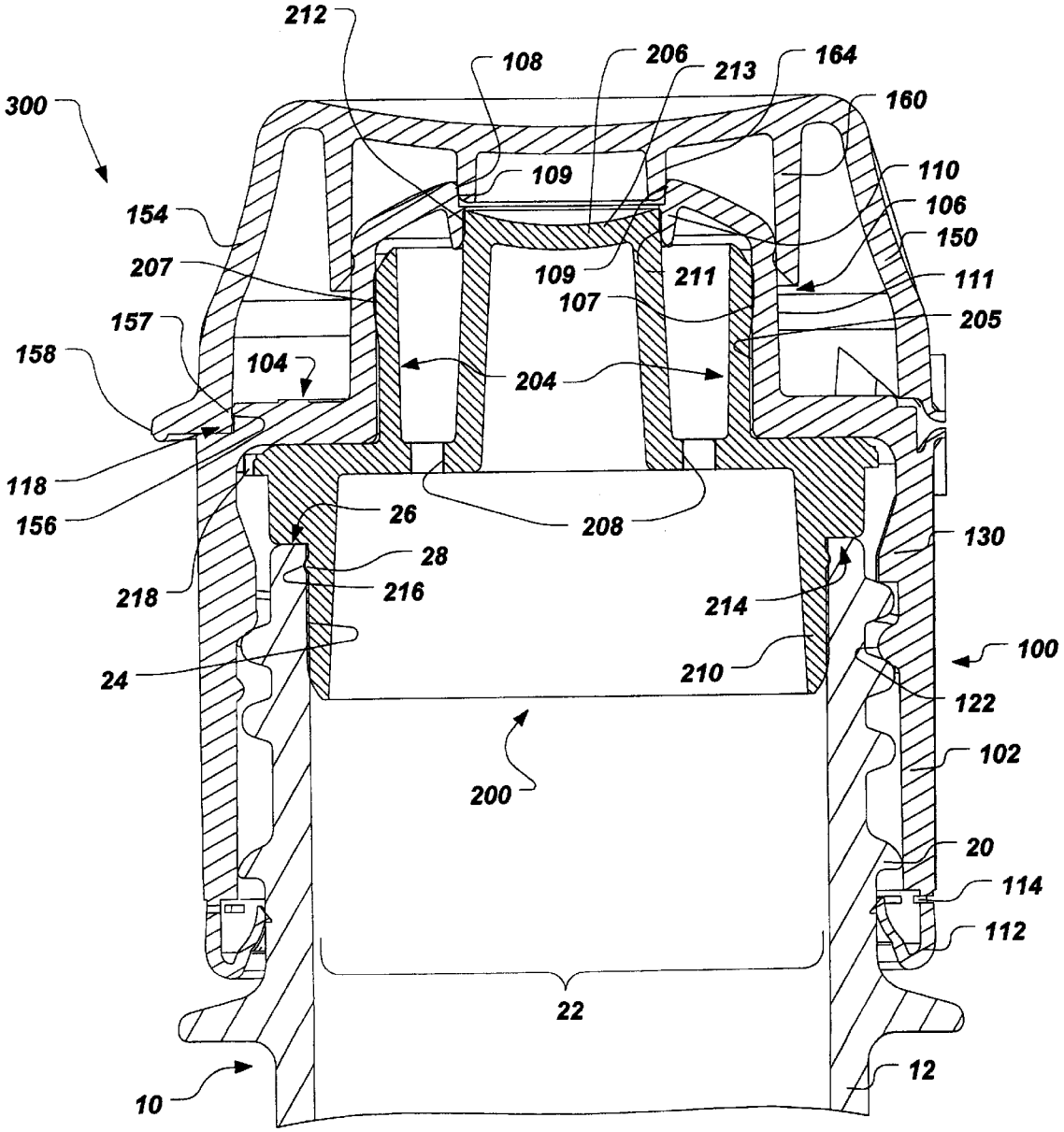
FIG. 12 is an enlarged, cross-section view taken generally along the plane defined by line 12—12 in FIG. 1.

FIG. 3 is an exploded perspective view showing the exemplary closure body 100 removed from the container 10 and exposing an exemplary fitment 200 according to the present invention. Referring additionally to FIGS. 4–7, fitment 200 is of a generally cylindrical shape and includes a fitment frame, which may include a fitment deck 202 and a downwardly extending annular plug seal 210 adapted to sealingly and frictionally engage the interior surface 24 of the container 10 as shown in FIG. 12. Annular plug seal 210 is thus formed with an outer radius dimensioned to provide adequate friction and sealing with the container interior surface 24 at the opening 22 of container 10. Preferably, an annular snap-fit sealing bead 216 is provided on the annular plug seal 210 for engaging a complementarily-shaped snap-fit sealing groove 28 formed on the interior surface 24 of the container 10.

Figure 4:
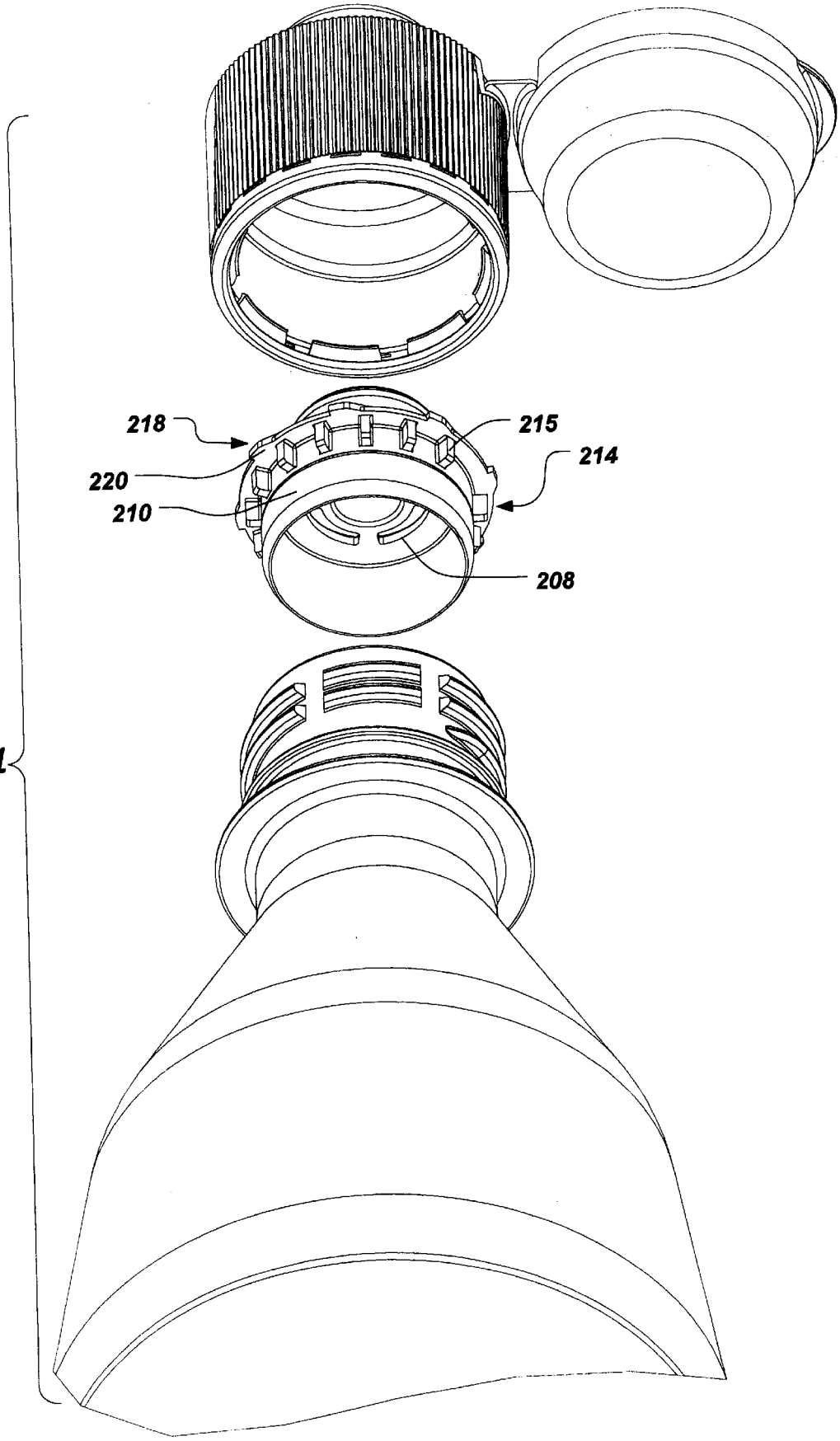
FIG. 4 is an exploded, perspective view of the exemplary dispensing closure of FIG. 1 showing the underside of the closure body and fitment.
Figure 6:
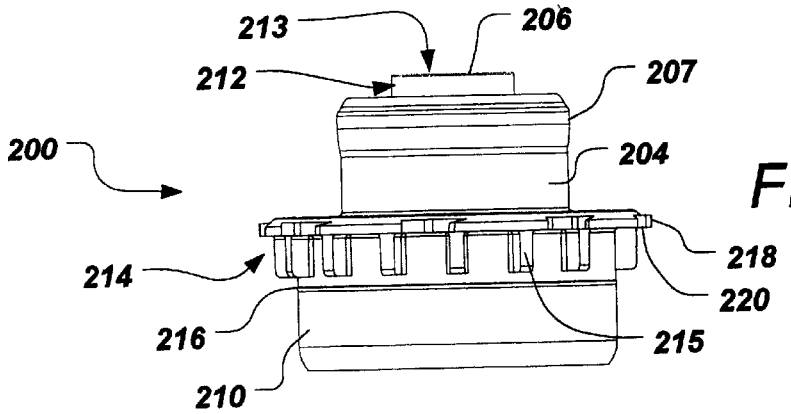
FIG. 6 is a side elevational view of the exemplary fitment according to a preferred embodiment of the invention.

As best seen from FIGS. 4 and 6, the frame of fitment 200 also includes an annular shoulder 214, which is preferably formed by a plurality of radially extending spokes or ribs 215 in order to reduce material cost. Annular shoulder 214 functions to limit the travel of fitment 200 as it is inserted into the container opening 22 and to provide a predetermined position of the fitment 200 relative to the container 10.

As best seen in FIG. 6, fitment 200 also includes an upwardly extending annular fitment sealing collar 204 which includes a sealing collar outer surface 205 for sealingly and slidingly engaging a spout interior sealing surface 107 on the spout 106 (FIG. 12). Preferably, the fitment sealing collar 204 is provided with a fitment sealing collar sealing bead 207 (FIGS. 6 and 12) for providing a tight, yet dynamic seal against the spout interior sealing surface 107.

Fitment 200 also includes one or more apertures 208 (FIGS. 4, 5, 7, and 12) that permit fluid flow through the fitment 200 from the inside of the container 10 to the interior of the sealing collar 204. Preferably, four apertures 208 are provided and extend along a generally circular path around the interior of the fitment sealing collar 204. The apertures 208 are defined in part by four radial struts 209 arranged generally at 90-degree intervals. As will be apparent to those of ordinary skill in the art, the size, shape, and number of apertures 208 and struts 209 may be varied without departing from the spirit and scope of the invention.

Struts 209 support the fitment sealing post 206 which forms an occluding portion of the fitment 200 and extends in a direction generally opposite to the fitment plug seal 210. Fitment sealing post 206 includes a fitment sealing surface 212 (FIG. 12) for sealingly engaging the surface 211 on the inside of the annular sealing sleeve 110 of the dispensing orifice 108 (FIG. 12). Fitment sealing post 206 also includes a distal sealing end 213 for occluding the dispensing orifice 108. Preferably, as best seen in FIG. 12, distal sealing end 213 is formed as a surface that is concave when viewed from the top. This structure provides increased strength and resiliency in response to radial inward forces generated when the annular sealing sleeve 110 engages the sealing post 206 as will be described. It will be apparent to the ordinarily skilled artisan that sealing end 213 may also be formed as a convex surface when viewed from the top or may have various other geometries without departing from the scope of the invention.

Figure 5:
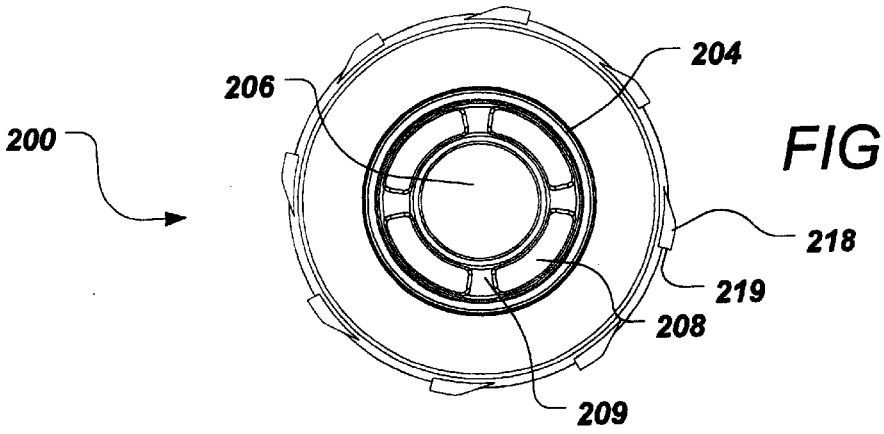
FIG. 5 is a top view of an exemplary fitment according to a preferred embodiment of the invention.
Figure 7:
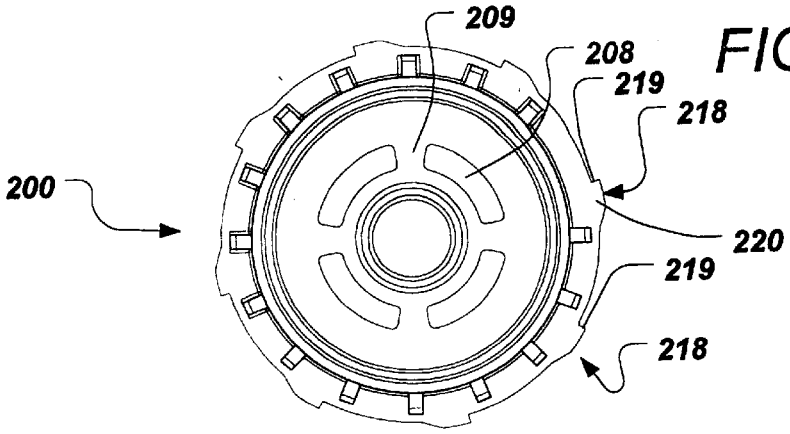
FIG. 7 is a bottom view of the exemplary fitment according to a preferred embodiment of the invention.

Referring particularly to FIGS. 5–7, in accord with a feature of one aspect of the invention, fitment 200 is provided with at least one, and preferably eight, radially extending projections or ribs 218, each preferably shaped as a ratchet or tooth and having an abutment surface 219 for engaging an inwardly projecting tab or rib 130 (FIGS. 12 and 13) on the closure body 100. These projections 218 may be shaped as a tooth or ratchet and function ultimately to prohibit rotational movement of the closure body 100 relative to the fitment 200 (and therefore relative to the container 10) as will be explained in more detail below. Each projection 218 also has a bottom surface 220 (FIGS. 4, 6, 13, and 15) which can function as a lifting surface by which the fitment can be removed from the container as described in detail hereinafter.

Although the exemplary fitment 200 is illustrated and described herein as being secured to the container 10 by virtue of a plug seal 210 and snap-fit sealing bead 216, it will be recognized by those of ordinary skill in the art that other fitment forms and securing implements and techniques are contemplated by the invention. For example, the fitment 200 may be secured to the container by means other than a plug seal and which other means may frictionally engage an exterior surface of the container 10 or features on the container finish. Specifically, the fitment 200 may be provided with fastening projections which engage the container thread or finish on an outside surface of the container neck.

Referring now to FIGS. 8–11, the closure body lid 150 is preferably provided with sealing features to provide sealing interfaces with the closure body deck 104, spout 106 and dispensing orifice 108 when the closure body lid 150 is in its closed position (shown in FIG. 1). For sealing with the closure body deck 104, the closure body lid 150 is preferably provided with a snap-fit retention bead 156 (FIGS. 8 and 11) which cooperates with a similar snap-fit retention bead 157 formed on the closure body 100 on the lid skirt-receiving shoulder 118 formed on the closure body deck 104.

Another sealing interface is provided by an annular spout-engaging collar 160 (FIGS. 11 and 12) formed on the closure body lid 150 and adapted to engage the spout 106 when the closure body lid is in its closed position. Preferably, the spout-engaging collar 160 is provided with a spout sealing bead 162 (FIG. 13) which sealingly engages an outer peripheral surface 111 of the spout as shown in FIG. 12. Still another sealing interface is provided by an annular flange or "spud" 164 (FIG. 13) extending from the closure body lid top wall 152. This spud 164 is adapted to sealingly engage an enlarged diameter upper portion 109 of the peripheral sealing surface 211 on the inside of the dispensing orifice 108 as shown in FIG. 12. Thus, the closure body lid 150 is provided with sealing features for creating respective seal interfaces with the closure body deck 104, the outside of the spout 106 and the dispensing orifice 108 on the inside of the spout 106.

Figure 14:
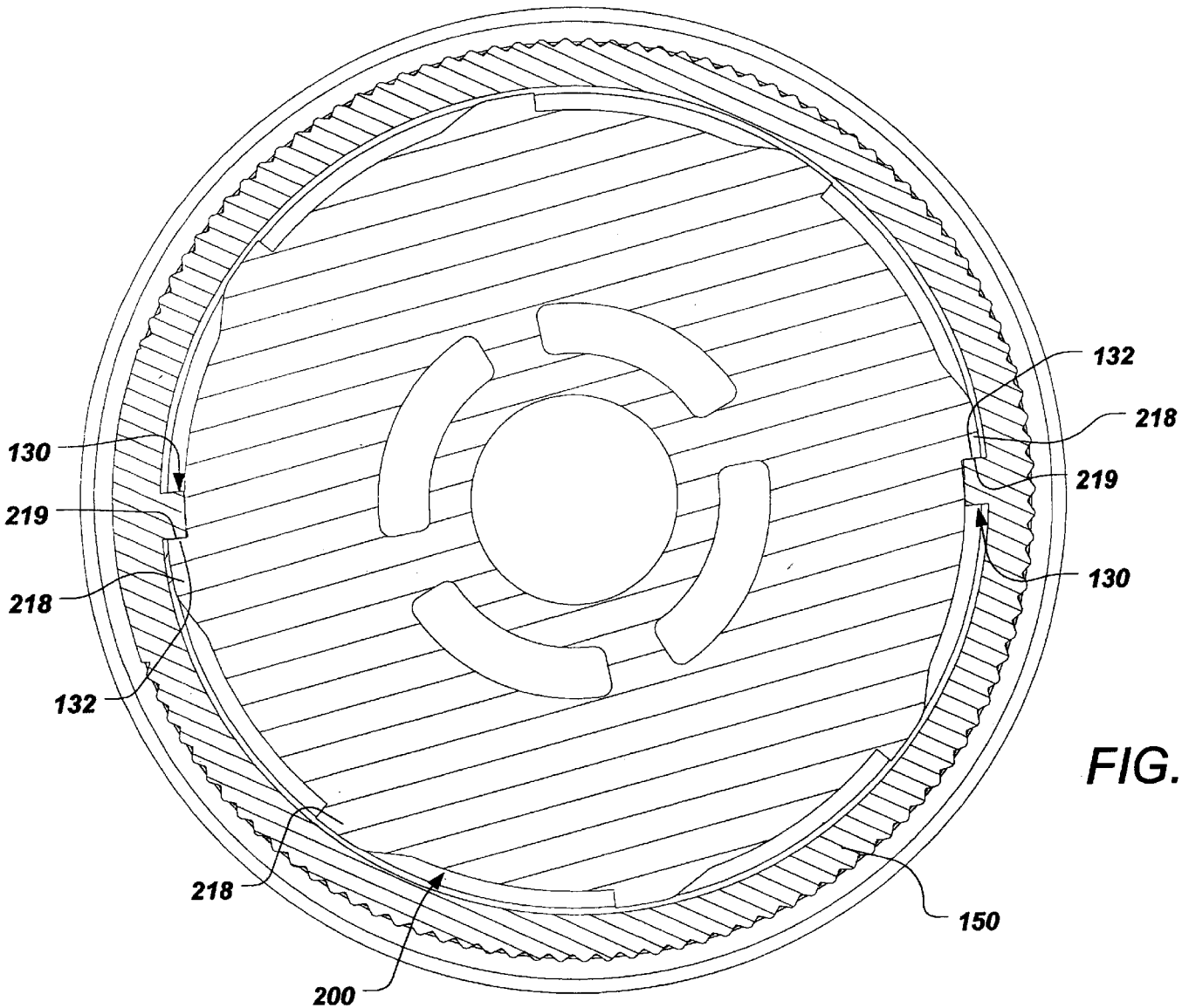
FIG. 14 is an enlarged, cross-section view taken generally along the plane defined by line 14—14 in FIG. 13.

Referring specifically to FIGS. 11 and 14, the closure body 100 is provided with at least one, and preferably two, inwardly projecting lugs, ribs or tabs 130 (only one tab is shown in FIG. 11). The tabs 130 include an abutment surface 132 (FIGS. 11 and 14) adapted to engage the abutment surface 219 on the fitment projections 218 in order to restrict rotational movement of the closure body 100 and provide positive tactile feedback to the user to indicate when the closure body 100 has been rotated to a fully opened dispensing position relative to the container 10 and therefore relative to the fitment 200.

Operation of the closure assembly 300 will now be explained with reference to FIGS. 12–15. FIG. 12 is a cross-section view illustrating the closure assembly 300 in a pre-tamper, closed and sealed shipping position. Here, the fitment 200 is located in a sealing position in which the fitment shoulder 214 engages an end surface 26 of the container 10, and the fitment plug seal 210 forms a high-pressure seal with the interior surface 24 of the container 10.

The closure body 100 is disposed in a closed position in which the dispensing orifice 108 is occluded by the fitment sealing post 206 and the closure body skirt 102 is fully threaded onto the container thread 16. The tamper-evident band or ring 112 is attached to the closure body skirt 102 via the unbroken, frangible connection 114. Notably, in this closed position of the closure body 100, the closure body projecting ribs or tabs 130 are disposed below, and out of engagement with, the fitment projections 218.

The closure body lid 150 is also shown in FIG. 12 in its closed position in which the closure body lid skirt 154 engages the closure body lid receiving shoulder 118 and is retained therein by the interaction of the lid snap-fit retention bead 156 with the closure body snap-fit retention bead 157. Annular spout-engaging sealing collar 160 on the closure body lid 150 engages the spout outer peripheral surface 111, and the spud 164 engages the enlarged diameter portion 109 of the dispensing orifice peripheral sealing surface 211. The thumb lift 158 of the closure body lid 150 extends outward beyond the radial extent of the closure body skirt 102 to permit a user to exert an upward force on the thumb lift 158 to lift the closure body lid 150 and move it to its open position (FIG. 13).

In accord with a feature of one aspect of the invention, there are six sealing interfaces provided by the exemplary closure assembly 300 when the closure assembly 300 is in its pre-tamper shipping position as shown in FIG. 12. A first high-pressure seal is formed between the fitment plug seal 210 and the interior surface 24 of the container 10. A second, and preferably high pressure, seal is formed between the fitment sealing post 206 and the annular sealing sleeve 110 of the dispensing orifice when the closure body is in the closed position. A third seal, which is a high-pressure seal, is formed between the fitment annular sealing collar 204 and the spout interior sealing surface 107. As will be explained, this third seal is a sliding, dynamic seal. A fourth seal is formed between the spud 164 and the portion upper 109 of the dispensing orifice peripheral sealing surface 211. A fifth seal is formed between the spout-engaging seal collar 160 of the lid and the spout outer peripheral surface 111. A sixth seal is formed between the closure body lid 150 and the closure deck 104 by the lid snap-fit retention bead 156 and the closure deck snap-fit retention bead 157. This aspect of the invention thus provides a plurality of seals, including high-pressure seals that are useful to maintain the pressurization of the container 10 when the contained fluid is a carbonated beverage, for example, or a pressurized liquid such as bottled water having a nitrogen charge for structural stability of the container 10.

Figure 13:
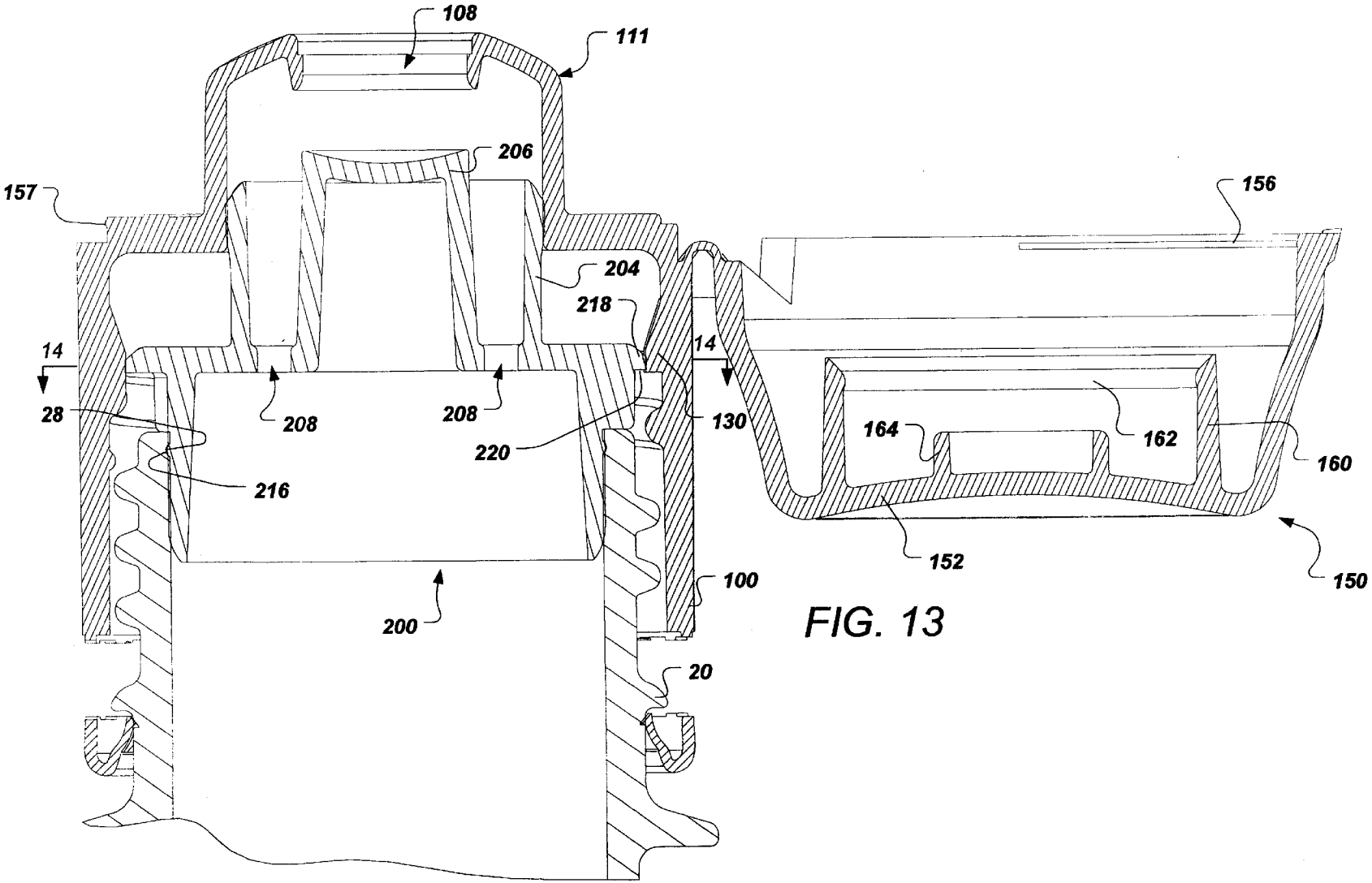
FIG. 13 is an enlarged, cross-section view taken generally along the plane defined by line 12—12 in FIG. 1, but showing the closure cap in an open position and the closure body rotated to an open position.

FIG. 13 is a cross-section view illustrating the closure assembly 300 in an open dispensing condition, in which the closure body lid 150 has been opened and pivoted about the hinge 120 to an open position and in which the closure body 150 has been rotated (counterclockwise when viewed from the top of FIG. 13) relative to the container 10 and fitment 200 and elevated relative to the container 10 and fitment 200. The tamper-evident band 112 has been separated from the closure body skirt 102 since the tamper-evident band 112 cannot move upward past the tamper-evident band retaining flange 20 on the container 10. The closure body orifice-defining surface 211 is preferably relatively long so as to maintain a seal against the post 206 for an amount of vertical travel of the closure body 100 relative to the container that is sufficient to break the frangible bridges of the tamper-evident drop ring. Only after the closure body 100 has moved vertically upwardly far enough to cause the drop ring to be completely broken away, does the surface 611 disengage from the post 206.

As the closure body 100 is further rotated, the closure body projecting tabs or ribs 130 will eventually elevate to a position in which at least one of the ribs 130 engages one of the fitment projections 218 (as shown in FIG. 13) to impose significant resistance to further rotation at the elevation which defines the fully open dispensing position of the closure body 100. FIG. 14 illustrates a cross-section showing the engagement of the closure body projecting ribs or tabs 130 with the fitment projections 218. This engagement provides a tactile feedback sensation to the user as an indication that the fully open condition has been reached. As will be appreciated by those of ordinary skill in the art, the location of the projecting tabs or ribs 130 may be selected to provide a desired clearance between the sealing post 206 and the dispensing orifice 108 when the closure body 100 has been rotated to the fully open dispensing position.

Dispensing of the container contents through the fully open closure assembly can occur because the fitment apertures 208 permit flow of the contents into the space between the fitment sealing post 206 and the fitment sealing collar 204 and out through the dispensing orifice 108. Dispensing, at lower flow rates, is also possible when the closure assembly is less than fully open. As will be recognized, the sealing collar 204 maintains a dynamic seal with the spout interior sealing surface 107 as the closure body 100 moves to its elevated, dispensing position.

In accordance with one aspect of the illustrated preferred embodiment of the invention, and in contrast to prior art devices, the same threads that are used to install the closure body on the container 10 are used to elevate the closure body to a dispensing position as shown in FIG. 13. Thus, additional threads or other implements need not be provided on the closure body 100 to provide for elevation of the closure body 100 relative to the sealing post 206. Owing to this feature of the invention, a single tamper-evident band 112, which may be a standard drop-ring known in the prior art, provides evidence of whether or not the closure body 100 has been unscrewed and thus evidence of whether the dispensing orifice 108 has been opened. As will be recognized by those of ordinary skill in the art, other suitable tamper-evident structures, such as a tear-off shrink-wrap seal, may be provided on the closure body lid 150 to evidence tampering with, or opening of, the closure body lid 150 relative to the closure body 100.

In accordance with yet another feature of the invention, the resealable dispensing closure assembly may be resealed after the closure body has been moved to the dispensing position and without further movement of the closure body relative to the container. After the closure body has been moved to the dispensing position, a user may pivot the lid to a closed position in which the spud 164 sealingly engages the upper portion 109 of the dispensing orifice peripheral sealing surface 211 and the spout-engaging seal collar 160 of the lid engages the spout outer peripheral surface 111. Also, when the lid is in the closed position, the closure body lid 150 engages the closure deck 104 by the lid snap-fit retention bead 156 and the closure deck snap-fit retention bead 157. Thus, the closure body lid can be utilized to seal the closure assembly while the closure body remains in the dispensing position. This feature of the invention provides the advantage of permitting easy resealing of the closure assembly by pivoting or placing the lid on the closure body, without requiring the user to exert the effort required for moving the closure body relative to the container and fitment.

Figure 15:
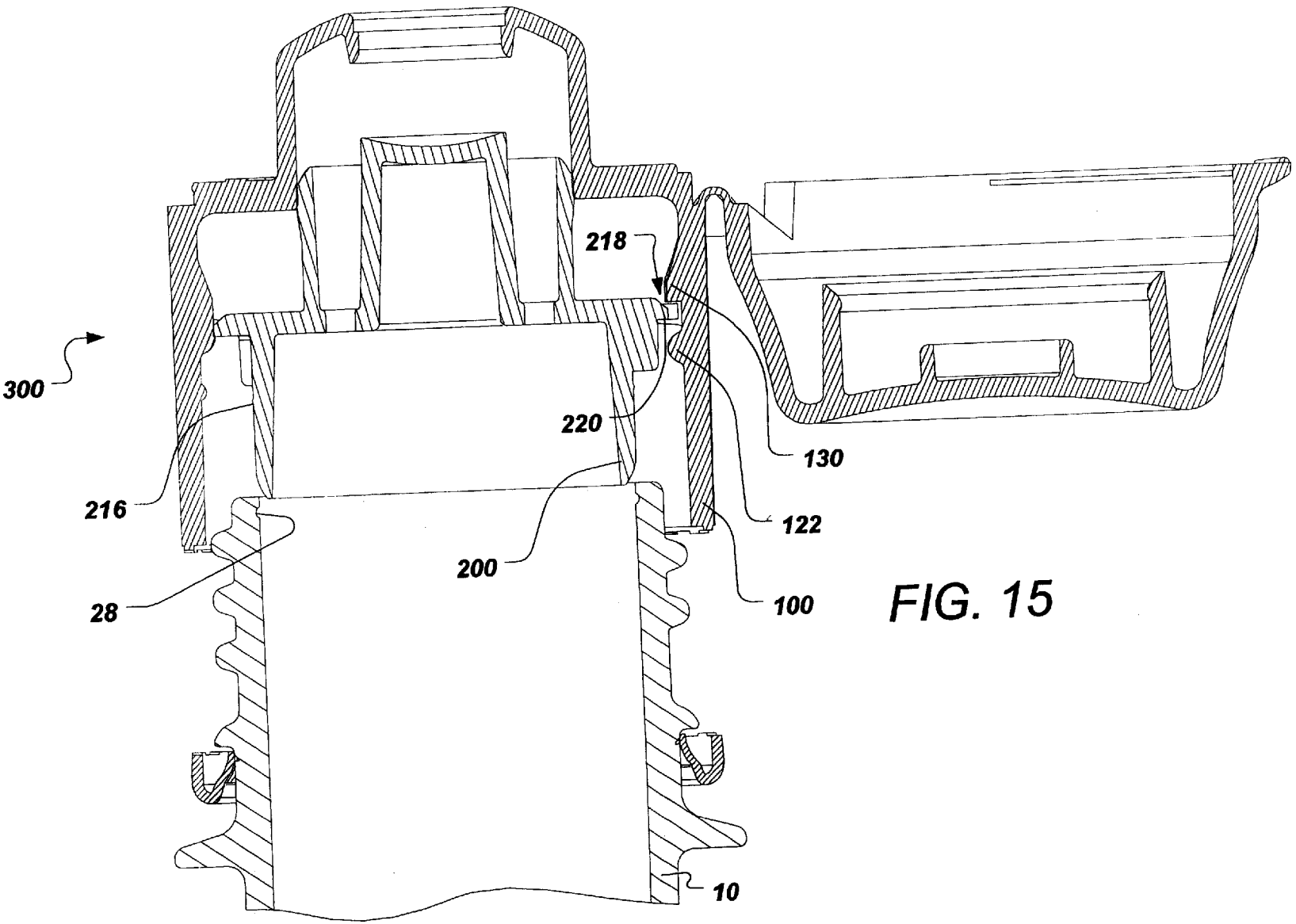
FIG. 15 is a cross-section view taken generally along the plane defined by line 12—12 in FIG. 1, but showing the closure body rotated beyond an open position to a position in which the fitment is lifted and disengaged from the container.
Figure 16:
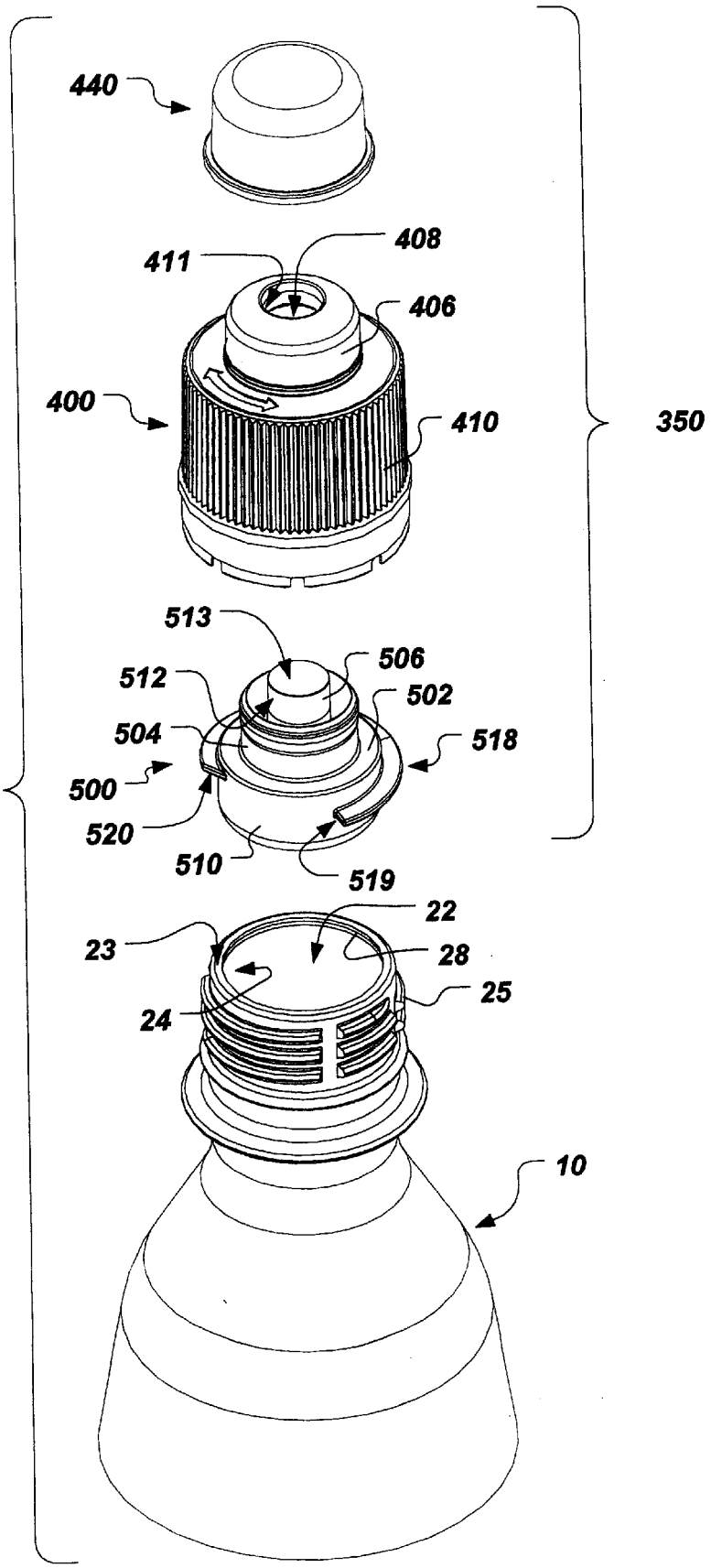
FIG. 16 is an exploded, perspective view of an exemplary dispensing closure assembly according to another preferred embodiment of the invention showing the overcap, closure body, and an exemplary fitment prior to installation on the container and showing the closure body in the as-molded condition—prior to turning up the tamper band (i.e., drop ring) at the bottom of the closure body skirt.
Figure 17:
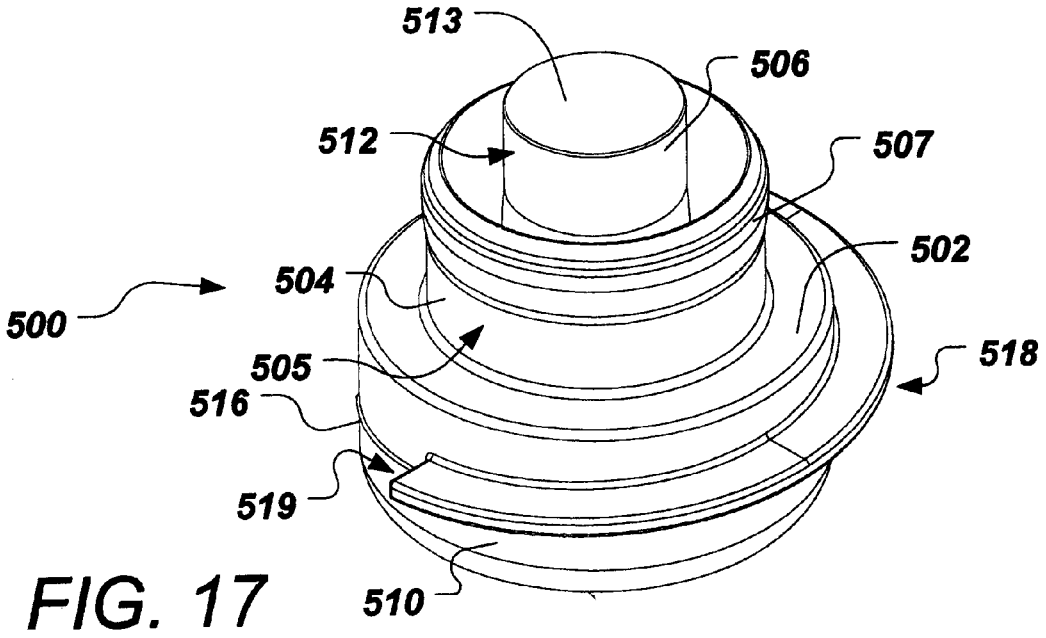
FIG. 17 is a perspective view of the exemplary fitment of FIG. 16 viewed as typically oriented on a container.

According to yet another aspect of the preferred embodiment of the invention, the closure assembly 100 may be reconfigured by the user to provide a second dispensing mode. Referring now to FIGS. 13–15, owing to the inventive features of the exemplary closure assembly 300, a user may remove the fitment 200 and, either (1) replace the closure body 100 on the container and have a resealable flip-top closure, or (2) leave the closure body off of the container and dispense the contents unobstructed through the container opening 22. A user may accomplish adaptation of the closure assembly 300 to such a second dispensing mode by continued rotation of the closure body 100 relative to the container 10 beyond the limits imposed by engagement of the closure body projecting lugs, tabs or ribs 130 with the fitment projections 218. Of course, the increased resistance to rotation must be overcome by the user applying more torque sufficient to temporarily and elastically deform either the ribs 130 or projections 218, or both, so that the ribs 130 override the projections 218 as the closure body 100 moves further upwardly and so that the ribs 130 eventually disengage completely from the fitment projections 218. Such over-rotation of the closure body 100 results in an engagement of the closure body thread 122 with the lifting surface 220 defined on the bottom of the fitment projections 218. This imposes an upward force on the fitment 200 and disengages the fitment snap bead 216 from the container groove 28. Continued rotation of the closure body 100 results in complete removal of the closure body 100 and fitment 200 from the container 10 as shown in FIG. 15. After the fitment 200 is removed, the user may reinstall the closure body 100 on the container 10 and dispense the container contents through the dispensing orifice 108, utilizing the closure body lid 150 to reseal the orifice 108 after use. Alternatively, the user may leave the closure body 100 removed and dispense the contents through the container opening 22. FIGS. 16–30 illustrate an exemplary closure assembly, generally referenced by the number 350 in FIG. 16, according to another preferred embodiment of the present invention. As best seen in FIG. 16, the closure assembly 350 generally comprises a closure body 400 having a cap 440 and cooperating with a fitment 500. In this embodiment, the fitment 500 is provided with a projection in the form of a helical flange 518, which, in a manner that will be explained in detail below, has at least two functions: 1) to provide an abutment surface for indicating to a user a stop position of the closure body; and 2) to provide an abutment surface for permitting the user to lift the fitment out of the container by further rotation of the closure body. The helical flange 518 thus provides functionality that is similar to the functionality provided by the projections 218 in the embodiment described above with respect to FIGS. 1–15. As will be explained in more detail below, the helical flange provides a high degree of tactile indication to the user when the closure body is rotated to the fully open position. Moreover, as will be explained, when the closure body is rotated beyond the fully open position, the helical flange transfers a lifting force uniformly from the closure body threads to the fitment to prevent cocking of the fitment within the container as the fitment is lifted upward and removed from the container.

Figure 26:
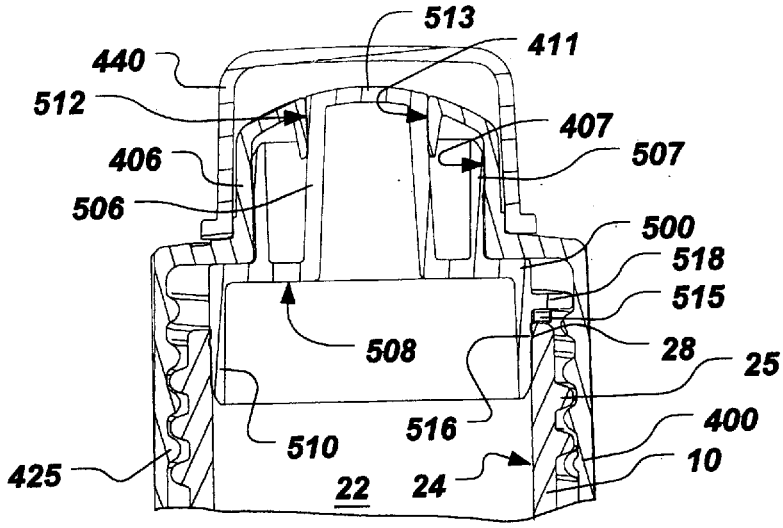
FIG. 26 is an enlarged, cross-section view of the exemplary dispensing closure assembly of FIG. 16 in a closed, pre-tamper position after installation on an exemplary container, which container forms no part of the invention.
Figure 27:
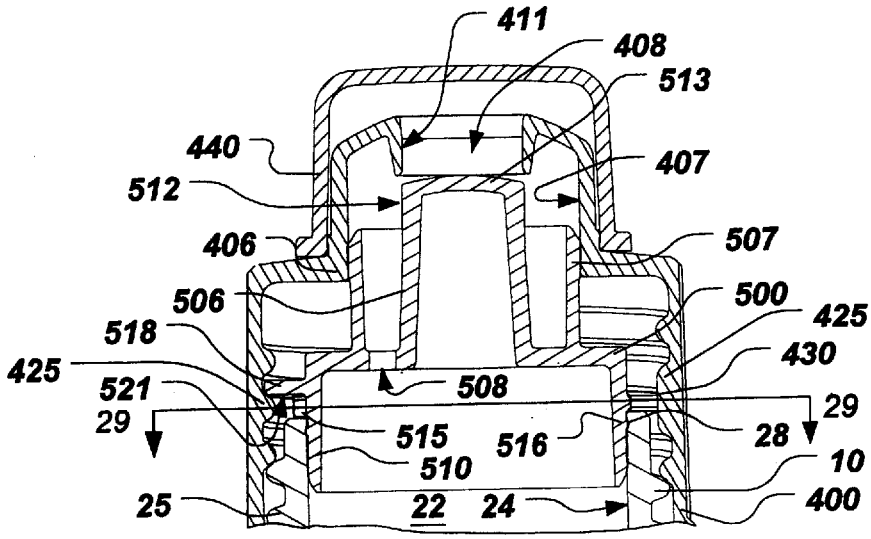
FIG. 27 is an enlarged, cross-section view of the exemplary dispensing closure assembly of FIG. 16 in an open, post-tamper position after installation on an exemplary container, which container forms no part of the invention.

As best seen with reference to FIGS. 16–22, fitment 500 is of a generally cylindrical shape and includes a fitment frame, which may include a fitment deck 502 and a downwardly extending annular plug seal 510 adapted to sealingly and frictionally engage an interior surface 24 of the container 10 as best shown in FIGS. 26 and 27. Annular plug seal 510 is thus formed with an outer radius dimensioned to provide adequate friction and sealing with the container interior surface 24 at the opening 22 (FIG. 16) of container 10. Preferably, an annular snap-fit sealing bead 516 is provided on the annular plug seal 510 for engaging a complementarily-shaped snap-fit sealing groove 28 (FIG. 16) formed on the interior surface 24 of the container 10.

Figure 18:
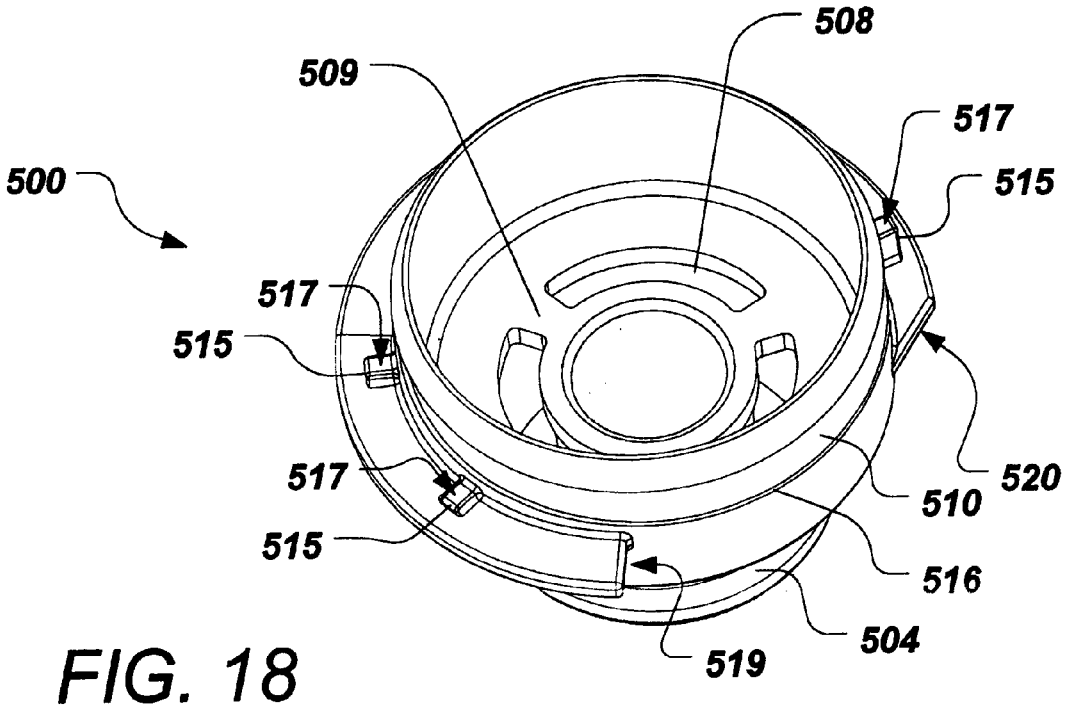
FIG. 18 is a perspective view of the exemplary fitment of FIG. 16 viewed from an underside thereof.
Figure 19:
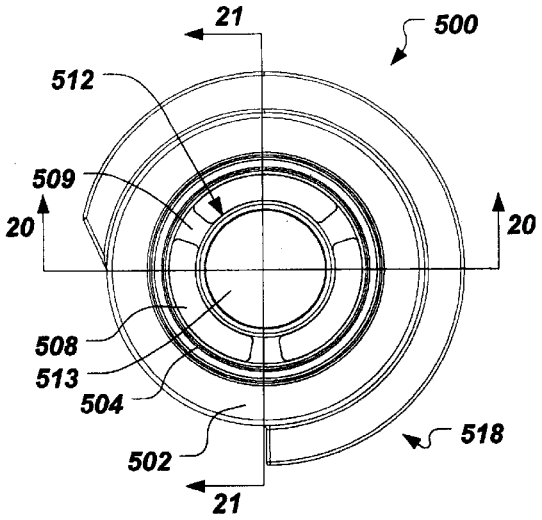
FIG. 19 is a top view of the exemplary fitment of FIG. 16.
Figure 22:
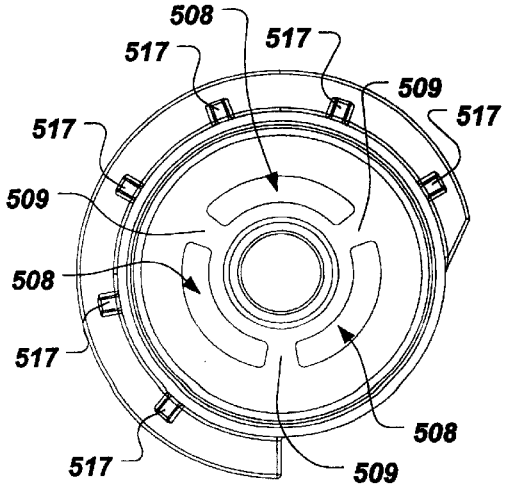
FIG. 22 is a bottom view of the exemplary fitment of FIG. 16.
Figure 23:
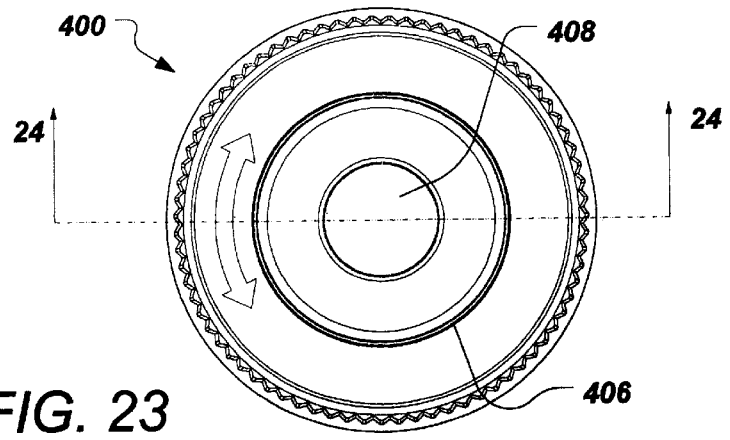
FIG. 23 is a top view of an exemplary closure body modified for use with the exemplary fitment of FIG. 16.

As best seen from FIGS. 18 and 22, the frame of fitment 500 also includes an annular shoulder, which is preferably formed by a plurality of spaced-apart, radially extending spokes or ribs 515, each including a bottom end 517. As will be recognized, the use of spokes or ribs 515 instead of a solid annular shoulder, which is also contemplated by the invention, will reduce material cost. The annular shoulder defined by spokes or ribs 515 functions to limit the travel of fitment 500 as it is inserted into the container opening 22 and to provide a predetermined position of the fitment 500 relative to the container 10.

As best seen in FIGS. 16, 17, 20, 21, 26 and 27, fitment 500 also includes an upwardly extending annular fitment sealing collar 504 which includes a sealing collar outer surface 505 for sealingly and slidingly engaging a spout interior sealing surface 407 on the spout 406 (shown in FIGS. 26 and 27 and described in detail hereinafter). Preferably, the fitment sealing collar 504 is provided with a fitment sealing collar sealing bead 507 (FIGS. 20, 21, and 26) for providing a tight, yet dynamic seal against the spout interior sealing surface 407.

As best illustrated in FIGS. 18–22, fitment 500 also includes one or more apertures 508 that permit fluid flow through the fitment 500 from the inside of the container 10 to the interior of the sealing collar 504. Preferably, three apertures 508 are provided and extend along a generally circular path around the interior of the fitment sealing collar 504. The apertures 508 are defined in part by three radial struts 509 arranged generally at 120-degree intervals. As will be apparent to those of ordinary skill in the art, the size, shape, and number of apertures 508 and struts 509 may be varied without departing from the spirit and scope of the invention.

Figure 21:
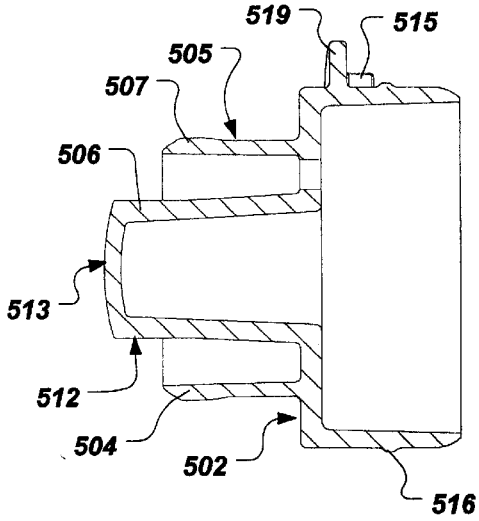
FIG. 21 is a cross-sectional view taken along the plane defined by the line 21—21 in FIG. 19.
Figure 20:
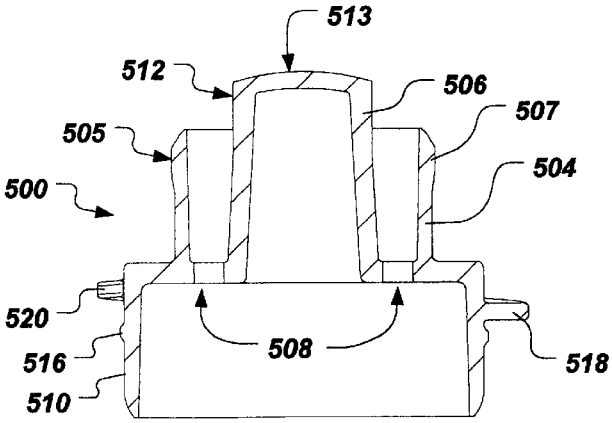
FIG. 20 is a cross-sectional view taken along the plane defined by the line 20—20 in FIG. 19.
Figure 28:
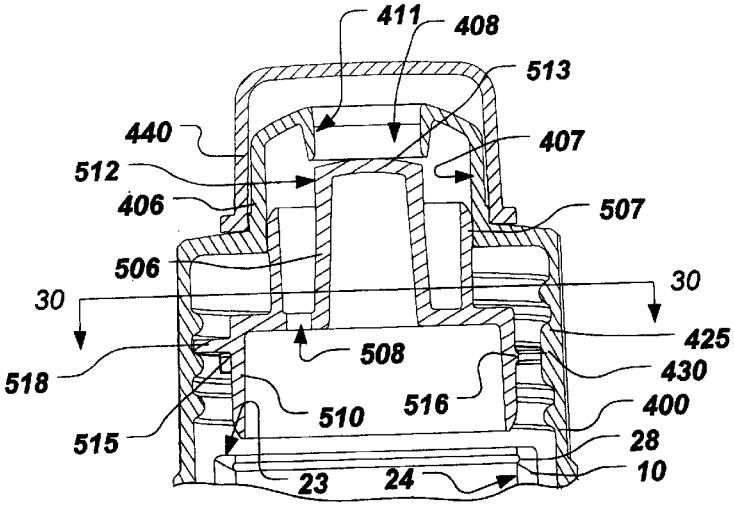
FIG. 28 is an enlarged, cross-section view of the exemplary dispensing closure assembly of FIG. 16 in which a closure body has been rotated past an open position to lift and remove a fitment from an exemplary container, which container forms no part of the invention.
Figure 29:
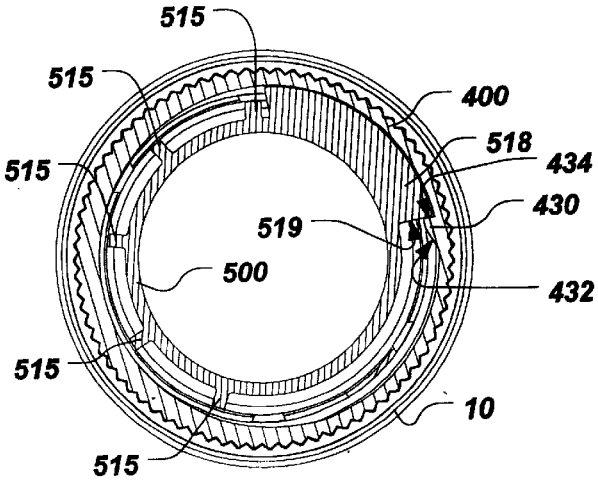
FIG. 29 is a cross-section view taken along the plane defined by the line 29—29 in FIG. 27.
Figure 30:
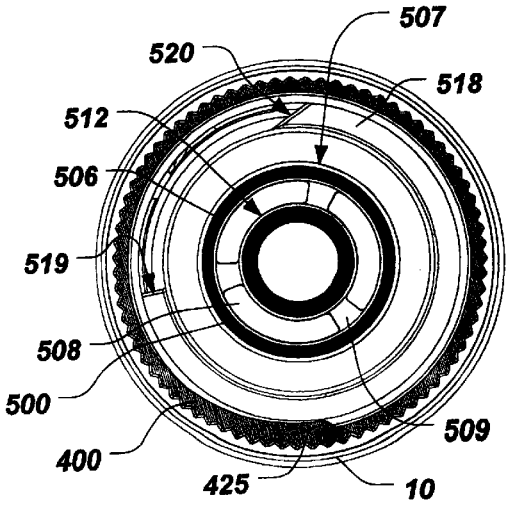
FIG. 30 is a cross-section view taken along the plane defined by the line 30—30 in FIG. 28.

Struts 509 support the fitment sealing post 506 which, as best shown in FIGS. 26–28, forms an occluding portion of the fitment 500 and extends in a direction generally opposite to the fitment plug seal 510. Fitment sealing post 506 includes a fitment sealing surface 512 (FIGS. 16, 17, 19–21, 26 and 27) for sealingly engaging the surface 411 (FIGS. 24, 26 and 27) on the inside of the annular sealing sleeve 410 which defines the dispensing orifice 408 of the body 400. Fitment sealing post 506 also includes a distal sealing end 513 (FIGS. 16, 17, 19–21, and 26–28) for occluding the dispensing orifice 408 (FIGS. 27 and 28). Preferably, as best seen in FIGS. 20 and 21, distal sealing end 513 is formed as a surface that is convex when viewed from the top. It will be apparent to the ordinarily skilled artisan that sealing end 513 may also be formed as a concave surface when viewed from the top or may have various other geometries without departing from the scope of the invention.

As best shown in FIGS. 16–22, in accordance with a primary feature of the invention, fitment 500 is provided with a projection in the form of the helical flange 518 extending radially outward from a portion of the fitment 500 between the fitment deck 502 and the plug seal 510. The helical flange 518 extends along a helical locus or path downward in a clockwise direction as viewed from the top of the fitment 500 when the fitment 500 is oriented in its upright position (shown in FIGS. 16 and 17) as installed on the container 10. The lead angle of the helical flange 518 is substantially the same as the lead angle of the container threads 25 (FIGS. 16 and 26–28), and it will be recognized by those of ordinary skill in the art that the fitment 500, when fully inserted into the container 10, operates to provide a continuation of the container threads 25. The helical flange 518 extends from a tapered leading end 520 (identified only in FIG. 18, 20, and 30) to a trailing end 519 which extends from the plug seal 510 in a substantially radial direction. The function of the leading end 520 and trailing end 519 will be explained below. As will be recognized, the bottom ends 517 of the spokes or ribs 515 lie substantially in the same plane and each engages the upper edge 23 (FIG. 16) of the container 10. The spokes or ribs 515 extend axially from the bottom ends 517 to the helical flange 518, and thus each of the spokes or ribs have different lengths (i.e., heights) depending on their angular position on the circumference of the fitment frame. For example, as seen in FIG. 18, the spoke or rib 515 of the least length (i.e., height) is disposed near the trailing end 519 of the helical flange 518 while the spoke or rib 515 of greatest length (i.e., height) is disposed near the leading end 520 of the helical flange 518.

Figure 24:
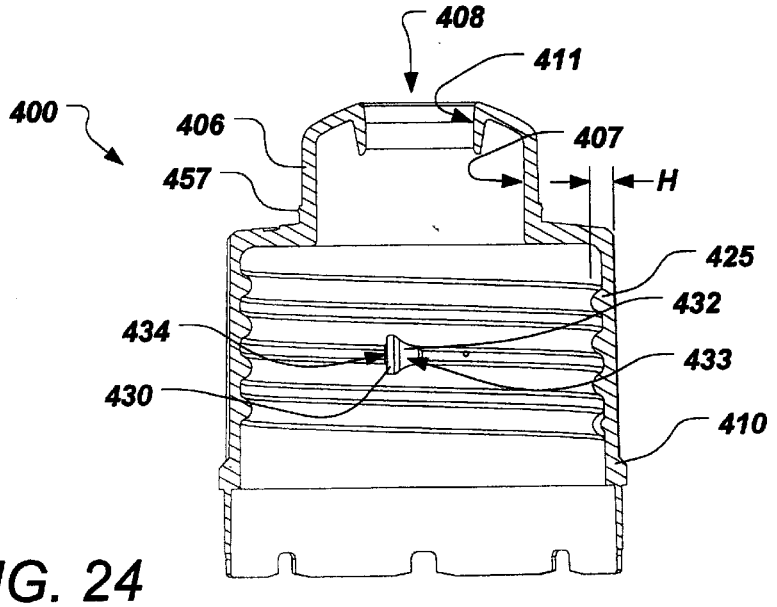
FIG. 24 is a cross-sectional view taken along the plane defined by the line 24—24 of FIG. 23.

Referring to FIGS. 16 and 23–25, in accordance with this preferred embodiment of the invention, the closure body 400 is provided with a general structure similar to that described with respect to FIGS. 1–15 above, including a closure body skirt 410 having at least one female thread 425 formed on an interior thereof. FIGS. 16 and 24 show the closure body 400 in an initially as-molded condition—prior to forming an optional, turned up tamper band (i.e., drop ring) at the bottom of the skirt 410 which could be similar to the first embodiment tamper band shown in FIG. 11.

Figure 25:
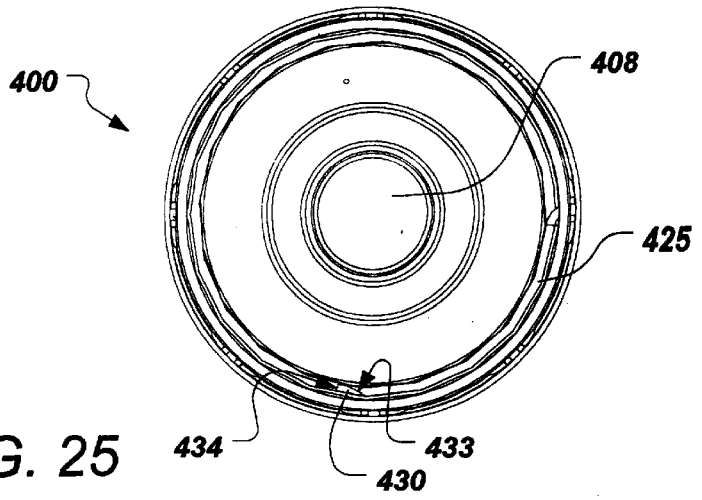
FIG. 25 is a bottom view of the exemplary closure body of FIG. 23.

As best seen in FIGS. 24 and 25, the exemplary closure body 400 according to this preferred embodiment of the invention is provided with a closure body projection or tab in the form of a generally wedge-shaped lug 430 within the female threaded portion of the closure body 400. Specifically, the lug 430 extends in a radial direction on the closure body 400 from the root of the thread radially inward to a height that does not substantially exceed the height H (FIG. 24) of the thread. The lug 430 includes a lead end 432 which has an inclined surface 433. The term "lead end" here refers to the end of the lug 430 which leads as the closure body 400 is being rotated onto the container (i.e., a clockwise direction when viewed from the top). The lug 430 also includes a trailing end 434 which extends substantially in a radial direction. It will be recognized that the lug 430 is preferably located within the female thread at a position where it will not interfere with complete installation of the closure body 400 onto the container 10.

Assembly and operation of the closure assembly 350 according to this preferred embodiment of the present invention will now be described with reference to FIGS. 16, 18, 19, 22 and 24–30. The fitment 500 is first installed on the container 10 forming a container/fitment assembly by inserting the plug seal 510 into the container opening 22, in an orientation (for example, FIG. 26) in which the helical flange 518 provides a continuation of the container thread 25. The closure body 400 is then installed onto the container/fitment assembly by rotating the closure body 400 in a clockwise direction when viewed from above. As this occurs, the closure body thread 425 will first engage the helical flange 518 and then engage the container thread 25. As the closure body 400 continues to be rotated, the lead end 432 of the closure body lug 430 will eventually encounter the tapered end 520 of the helical flange lead end. At this point, the inclined surface 433 (FIG. 25) of the lead end 432 of the closure body will slide over the tapered end 520 (FIGS. 18, 19 and 22) of the helical flange 518, slightly deforming either the closure body 400 or the helical flange 518 or both as the lead end of the closure body lug 430 continues to slide along the outer peripheral edge of the helical flange 518. During this sliding movement, deformation of either the closure body 400 or the helical flange 518 or both will continue. As rotation of the closure body 400 relative to the fitment 500 and the container 10 continues, the closure body lug 430 will eventually move beyond the flat end 519 of the helical flange 518, at which point the closure body 400 or the helical flange 518 or both will return to their undeformed state. The closure body 400 can continue to be rotated to the installed, closed position shown in FIG. 26.

As will be recognized by those of ordinary skill, the trailing end 434 of the closure body lug 430, in conjunction with the flat end 519 of the helical flange 518 will resist reverse rotation (counterclockwise) of the closure body 400 relative to the fitment 500 to the extent that the frictional engagement between the fitment 500 and container 10 prevents the fitment 500 from turning in the container 10. However, the fitment 500 will turn with the closure body 400 if the closure body 400 is rotated in a counterclockwise direction with sufficient torque to overcome the frictional engagement between the fitment 500 and container 10.

The closure body 400 is typically provided with a tamper-evident feature at its bottom edge which is secured to the container finish when the closure body 400 reaches its installed position shown in FIG. 26. To this end, the bottom of the closure body skirt 410 could be provided with frangible connections (not shown, but similar to connections 114 in the first embodiment described with reference to FIG. 12), and the bottom edge could be turned up prior to screwing the closure assembly 350 on the container 10, to form a break-away, tamper band similar to the first embodiment tamper band shown in FIG. 12.

Lastly, the cap 440 can be installed on the closure body 400. Alternatively, the cap 440 could be initially installed on the closure body 400, and then the cap 440 and closure body 400 could be installed together as a unit on the container/fitment.

As will be understood, the closure cap 440 is removably secured on the closure body 400 using, for example, a seal bead on the base of the closure body spout 406.

Once the closure assembly 350 is initially assembled on the container 10, the closure assembly 350 may be opened and resealed in accordance with another primary feature of the invention. Specifically, the fitment 500 will function to provide a positive stop for a tactile sensation as to when the closure body 400 has been rotated to a fully open position. This is accomplished by the unique interaction of the closure body 400 with the fitment 500. The plug seal 510 and therefore the fitment 500 are frictionally engaged within the neck of the container 10 so that the fitment 500 resists rotation and axial movement relative to the container 10. As the closure body 400 is rotated from the fully closed position shown in FIG. 26, in a counterclockwise direction as viewed from above, it will rotated relative to the container 10 and move upward relative to the container in an axial direction to the position shown in FIG. 27, thereby permitting flow through the fitment 500. If a lower tamper band had been provided, it will break. The closure body orifice-defining surface 411 is preferably relatively long so as to maintain a seal against the post 506 for an amount of vertical travel of the closure body 400 relative to the container that is sufficient to break the frangible bridges of the tamper-evident drop ring. Only after the closure body 400 has moved vertically upwardly far enough to cause the drop ring to be completely broken away, does the surface 411 disengage from the post 506. The cap 440 may be removed to permit dispensing and then replaced on the closure body 400 when the closure body 400 is in the open position to seal the closure assembly 350 without requiring movement of the closure body to the closed position.

Since the pitch of the helical flange 518 is substantially the same as the pitch of the container threads 25 and the closure body threads 425, the closure body 400 rotates relative to the frictionally restrained fitment 500, moving the closure body lug 430 (which is initially disposed below the helical flange 518) relative to the helical flange 518 and eventually into abutting engagement with the trailing end 519 of the helical flange 518. As shown best in FIG. 29, at the full open position, the trailing end 519 of the helical flange 518 is in abutting engagement with the trailing end 434 of the closure body lug 430, thereby resisting further rotation of the closure body 400 in a counterclockwise direction in FIG. 29. At this point, a positive tactile indication is given to the user that the closure body 400 has been rotated to the fully open position. As will be recognized, the abutting engagement of the trailing end of the lug 430 and the trailing end of the helical flange 518 results in a force that opposes the user's attempt to further rotate the closure body 400 beyond the fully open position.

According to a unique feature of this exemplary embodiment of the invention, as best seen in FIG. 27, when the closure body 400 is in the fully open position, the helical flange 518 is engaged on a lower surface 521 thereof by the closure body thread 425, thus providing a second abutting interface to resist user-applied opening force, i.e., torque tending to rotate the closure body 400 in a counterclockwise direction as viewed from above.

According to a further feature of the invention, the closure body 400 may be used to remove the fitment 500 from the container, to permit a second dispensing mode. Since lug 430 prohibits further rotation of the closure body 400 in an opening direction relative to fitment 500, application of an increased opening torque to the closure body 400 tends to cause the fitment 500 to overcome its frictional engagement with the container neck and to turn with the closure body 400 and relative to the container 10, thereby resulting in the closure body thread 425 exerting an upward force on the lower surface 521 of the helical flange 518.

To accomplish removal of the fitment 500, the user applies sufficient torque to the closure body 400, while the closure body 400 is in the fully open position, to overcome the frictional engagement of the fitment plug seal 510 with the container interior surface 24 and to push the fitment snap bead 516 out of the container neck groove 28. Application of such an increased torque will result in continued rotation of the closure body 400 beyond the fully open position and a lifting force applied to the lower surface 521 of the helical flange 518. As will be recognized by those of ordinary skill in the art, a relatively uniform force is applied to the underside of the helical flange 518, resulting in a smooth upward movement of the fitment 500 out of the container opening as the closure body 400 continues to be rotated. This uniform application of force results in less tendency for the fitment 500 to become misaligned during removal. Continued rotation of the closure body 400 in the opening direction will eventually cause disengagement of the closure body from the container neck.

Once the closure body 400 and fitment 500 have been removed from the container 10, the closure assembly 400 may be reconfigured into a second dispensing mode by removal of the fitment 500 from the closure body 400. Removal of fitment 500 may be accomplished, for example, by the user deforming the closure body 400 into a slight oblong shape in order to permit disengagement of the closure body lug 430 from the trailing end 519 (FIG. 29) of the helical flange 518. This will permit rotation of the closure body 400 in a counterclockwise direction relative to the fitment 500 as viewed in FIG. 29 and subsequent removal of the fitment 500 from the closure body 400. The closure body 400 may then be reinstalled on the container 10 without the fitment 500, and this will permit a second dispensing mode in which dispensing may occur at a rate greater than the rate permitted by the fitment apertures 508.

Figure 31:
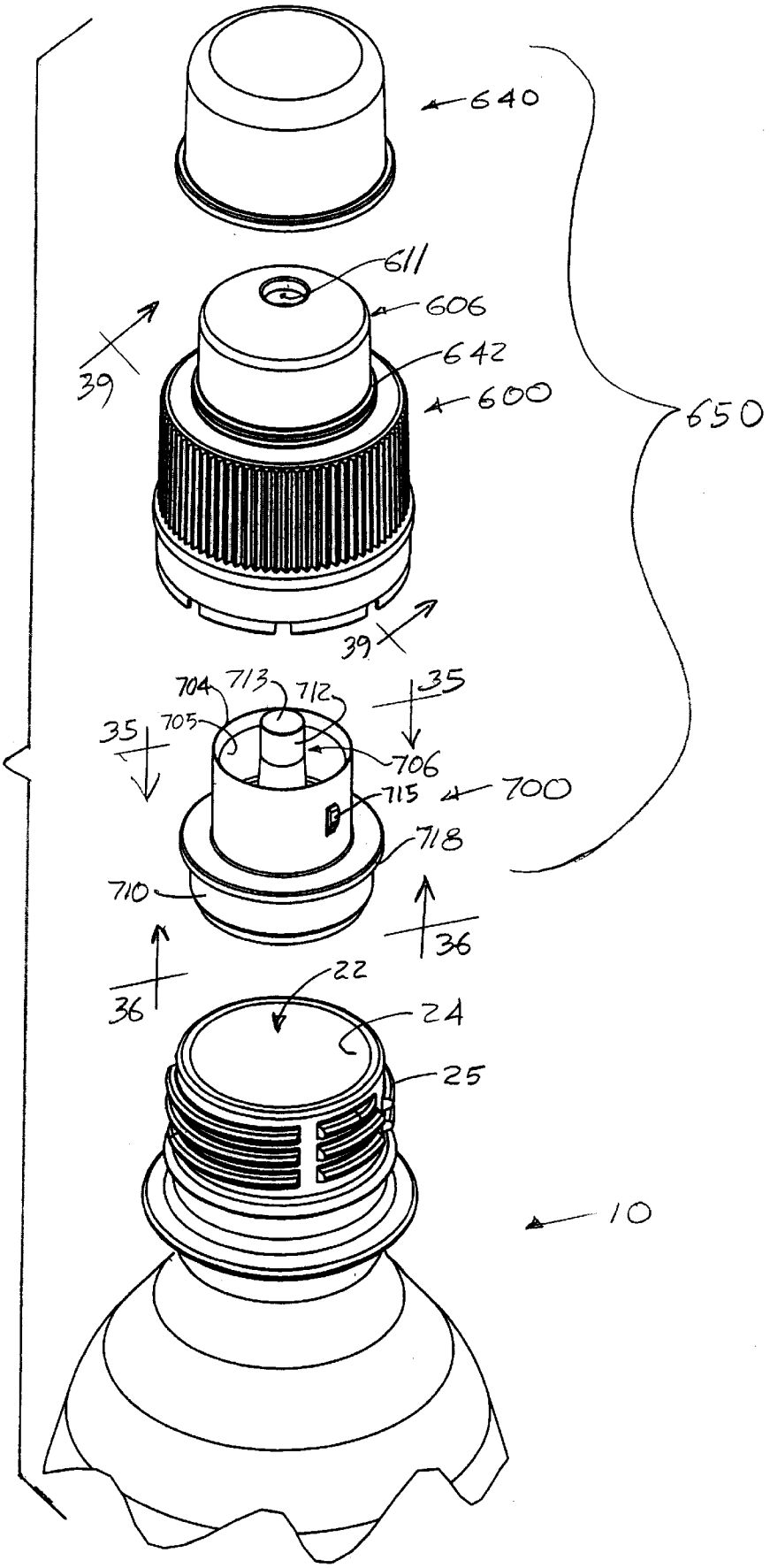
FIG. 31 is an exploded, perspective view of an exemplary dispensing closure assembly according to another preferred embodiment of the invention showing the fitment, closure body, and overcap prior to installation on the container and showing the closure body in the as-molded condition—prior to turning up the tamper band (i.e., drop ring) at the bottom of the closure body skirt.

FIGS. 31–40 illustrate an exemplary closure assembly, generally referenced by the number 650 in FIG. 31, according to another preferred embodiment of the present invention. As best seen in FIG. 31, the closure assembly 650 generally comprises a closure body 600 having an overcap or cap 640 and a cooperating fitment 700.

In this embodiment, the fitment 700 is provided with a projection in the form of a flange 718. The flange 718 functions to limit the travel of fitment 700 as it is inserted into the container opening 22 and to provide a predetermined vertical position of the fitment 700 relative to the container 10.

Figure 32:
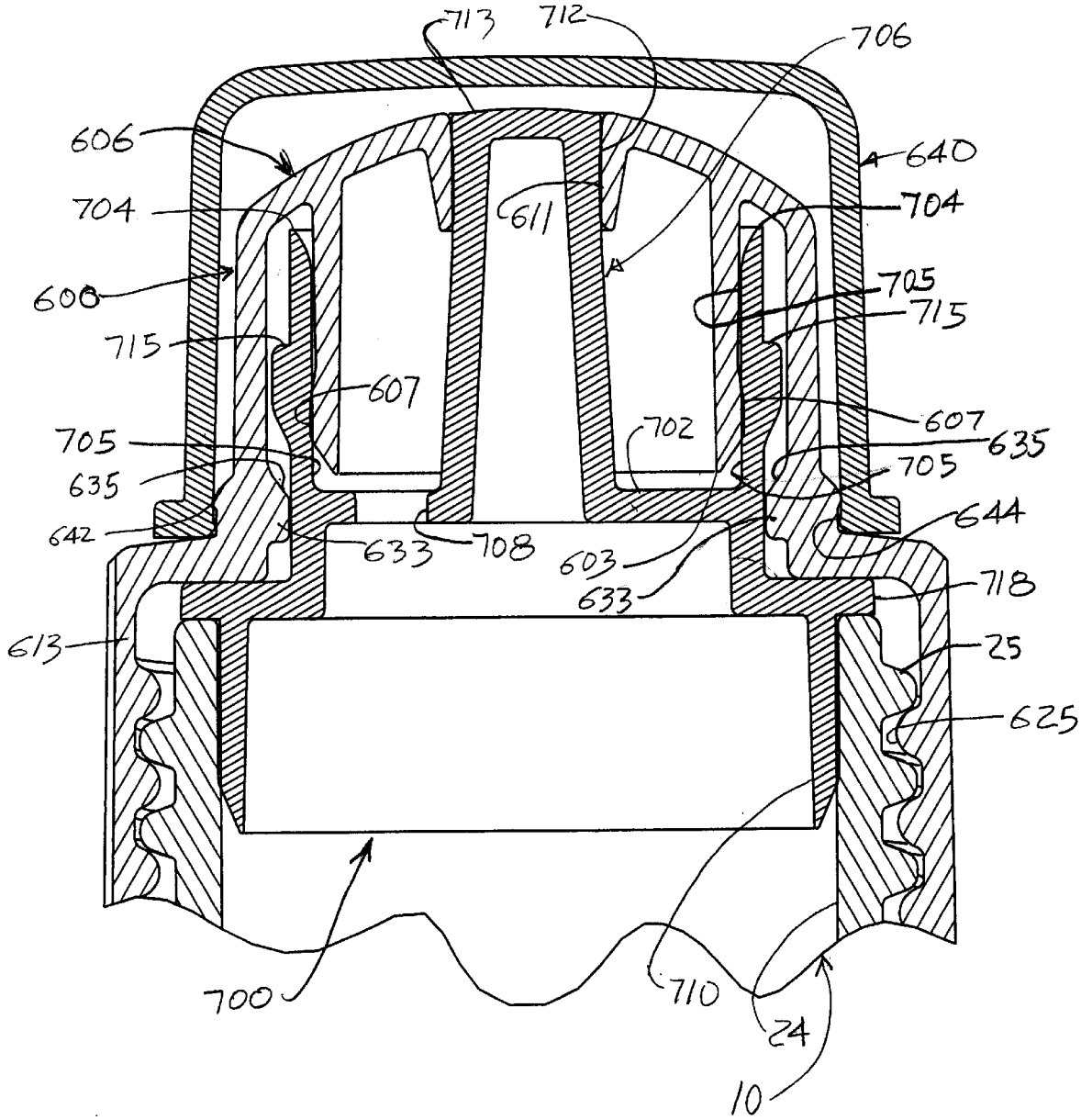
FIG. 32 is an enlarged, cross-sectional view of the dispensing closure assembly of FIG. 31 in a closed, pre-tamper position and installed on an exemplary container, which container forms no part of the present invention.
Figure 37:
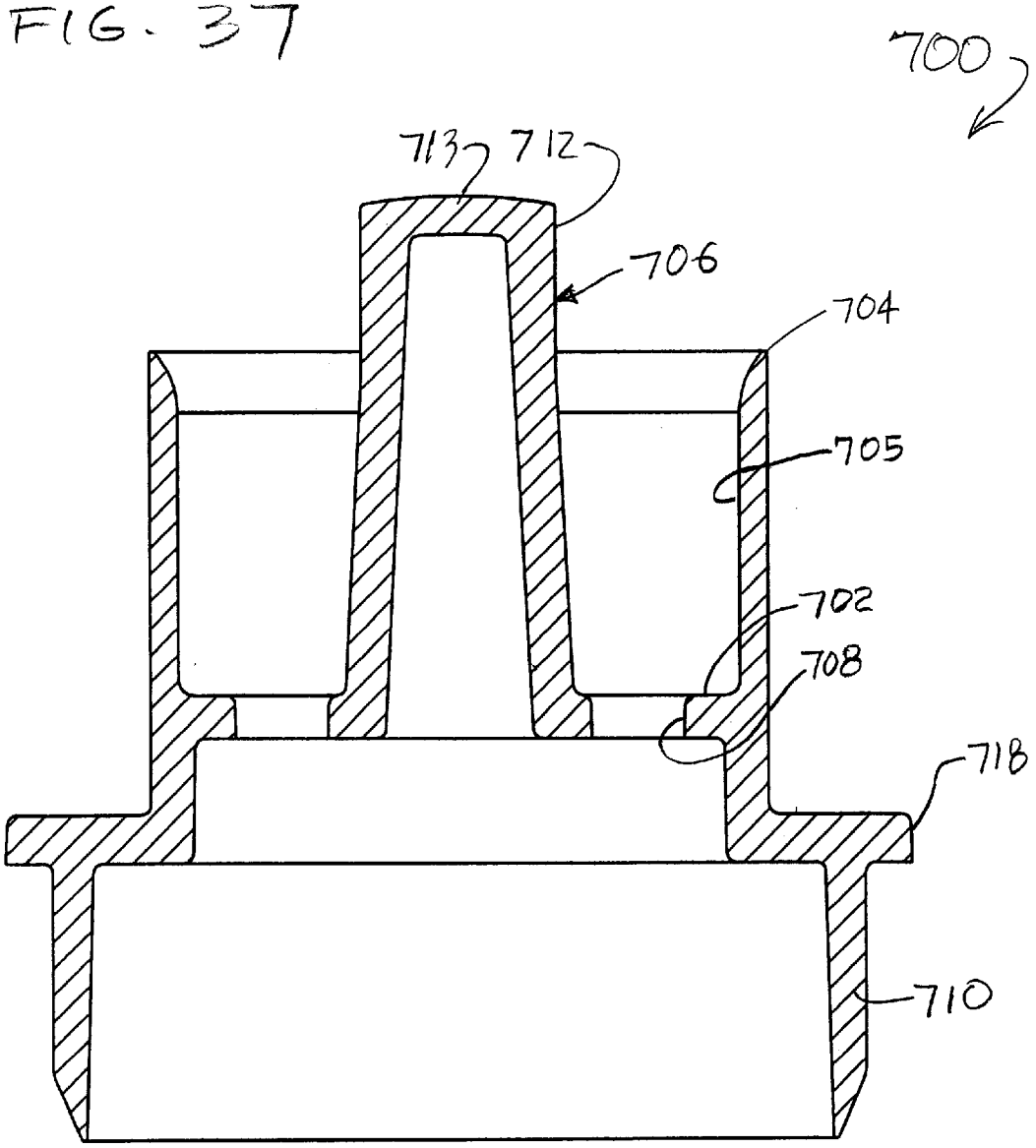
FIG. 37 is a cross-sectional view taken generally along the plane 37—37 in FIG. 35.

As best seen with reference to FIGS. 31–34, fitment 700 is of a generally cylindrical shape and includes a fitment frame which preferably includes at least a fitment deck 702 (FIGS. 31 and 37). Below the deck 702 is a downwardly extending annular plug seal 710 (FIGS. 31 and 37) adapted to sealingly and frictionally engage an interior surface 24 of the opening 22 of the container 10 as best shown in FIG. 32. Annular plug seal 710 is thus formed with an outer circumference dimensioned to provide adequate friction and sealing with the container interior surface 24.

The fitment 700 also includes an upwardly extending annular fitment sealing collar 704 (FIGS. 31 and 34) which defines a sealing collar inner surface 705 for sealingly and slidingly engaging a spout exterior sealing surface 607 on an annular sealing collar 603 of the closure body spout 606 (shown in FIG. 32 and described in detail hereinafter).

Figure 34:
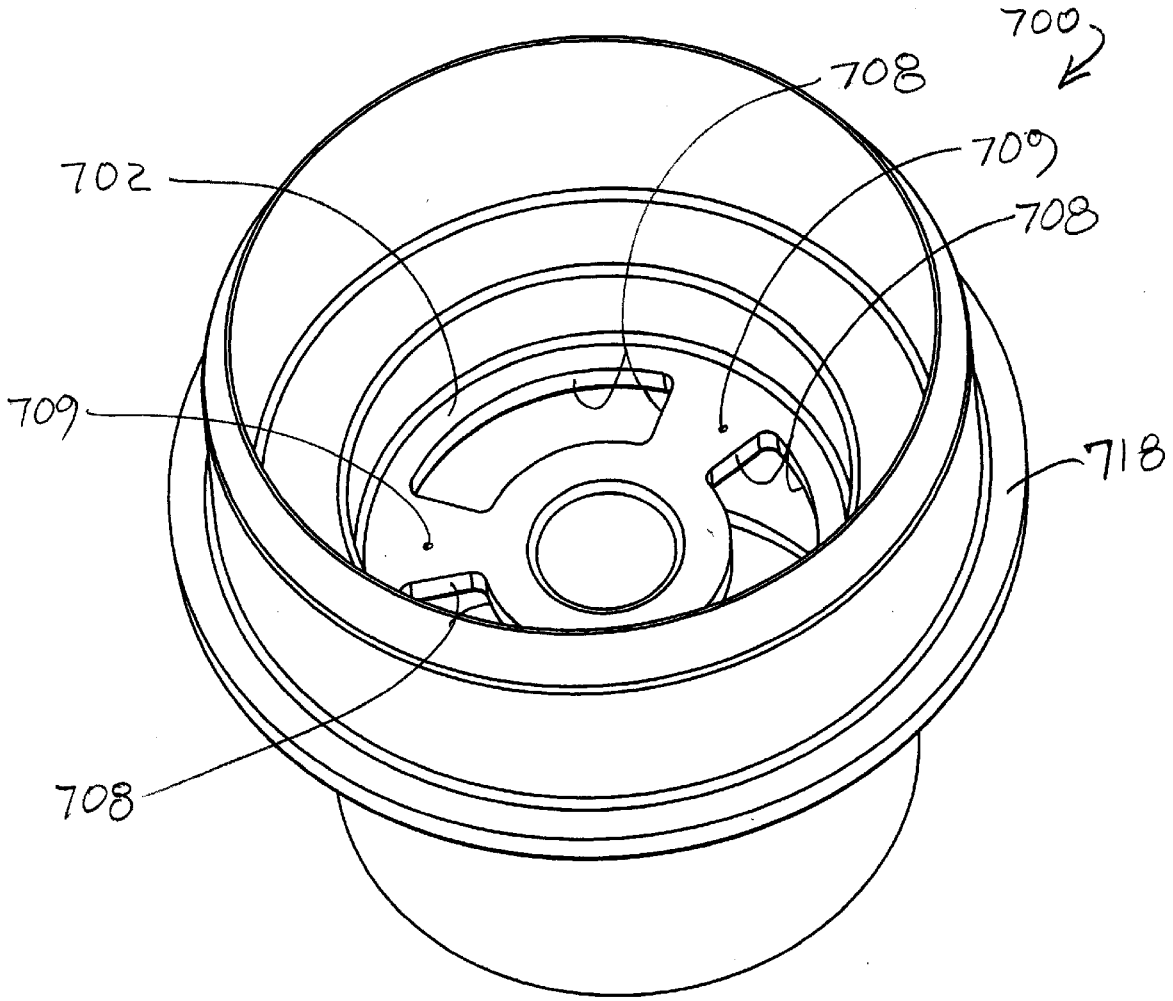
FIG. 34 is a perspective view of the fitment of FIG. 31 viewed from the underside of the fitment.

As best illustrated in FIG. 34, fitment deck 702 defines one or more apertures 708 that permit fluid flow through the fitment 700 from the inside of the container 10 to the interior of the sealing collar 704. Preferably, three apertures 708 (FIG. 35) are provided and extend along a generally circular path around the interior of the fitment sealing collar 704. The apertures 708 are defined in part by three radial struts 709 arranged generally at 120-degree intervals. As will be apparent to those of ordinary skill in the art, the size, shape, and number of apertures 708 and struts 709 may be varied without departing from the spirit and scope of the invention.

Figure 35:
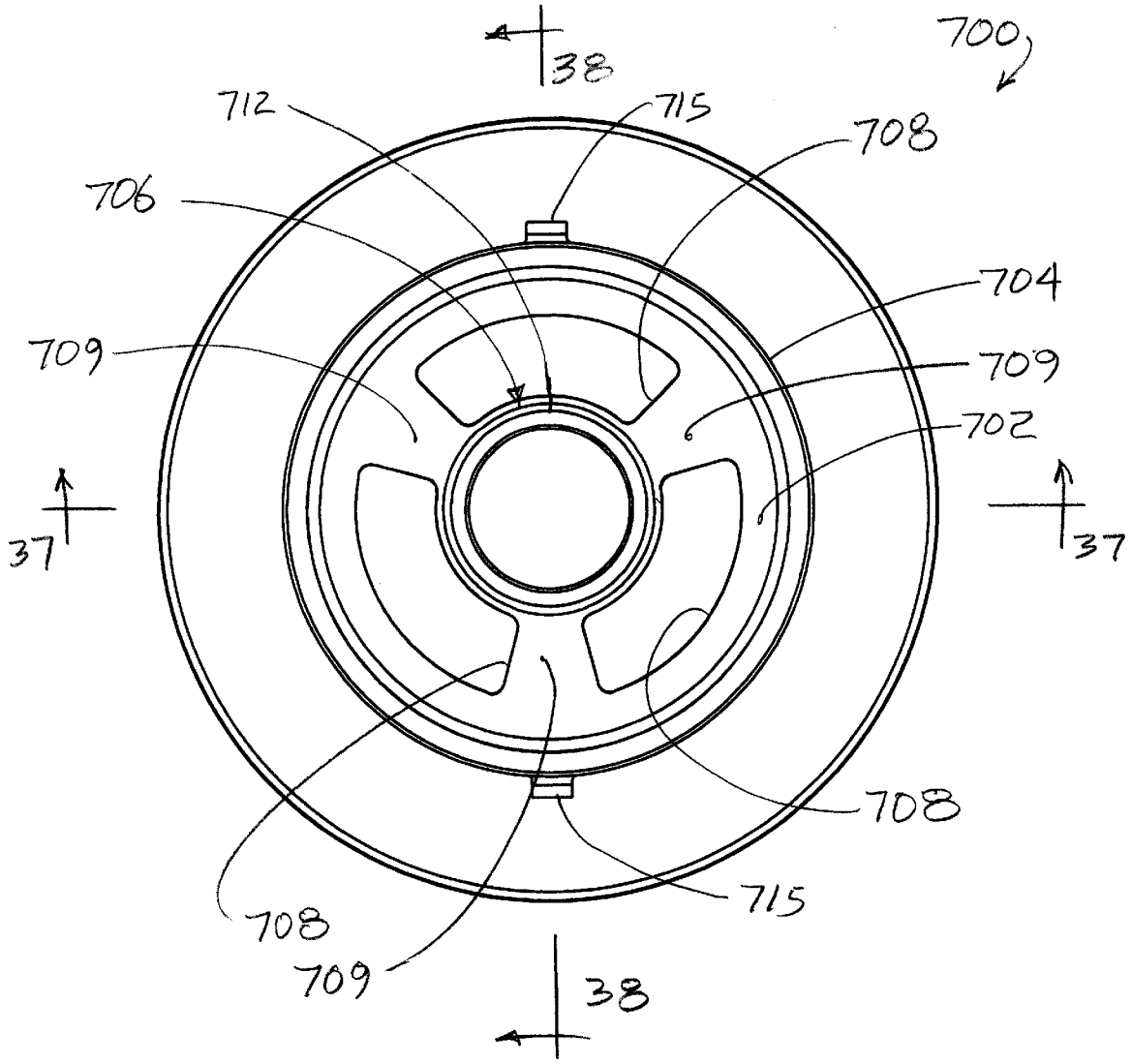
FIG. 35 is a top plan view of the fitment taken generally along the plane 35—35 in FIG. 31.
Figure 36:
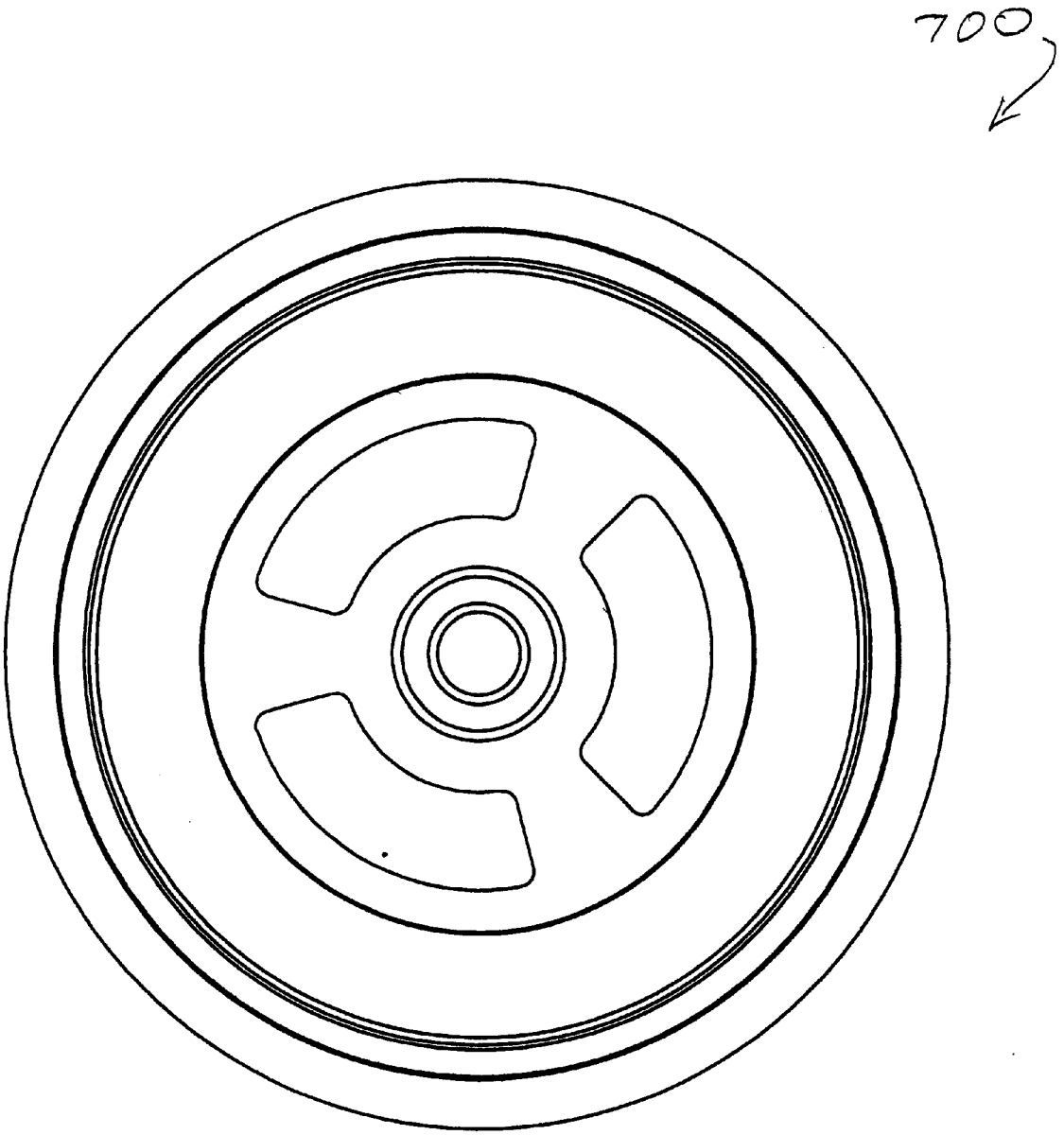
FIG. 36 is a bottom plan view of the fitment taken generally along the plane 36—36 in FIG. 31.

Struts 709 support a fitment sealing post 706 which, as best shown in FIGS. 35 and 37, forms an occluding portion of the fitment 700 and extends in a direction generally opposite to the fitment plug seal 710. Fitment sealing post 706 includes a fitment sealing surface 712 (FIGS. 31 and 37) for sealingly engaging a surface 611 (FIGS. 31, 32, 33, and 39) on the inside of an annular sealing sleeve 610 (FIG. 39) which defines a dispensing orifice 608 of the closure body 600.

Fitment sealing post 706 also includes a distal sealing end 713 (FIGS. 31, 32, 33, and 37) for occluding the dispensing orifice 608 (FIG. 32). Preferably, as best seen in FIG. 31, distal sealing end 713 is formed as a surface that is convex when viewed from the top. It will be apparent to the ordinarily skilled artisan that sealing end 713 may also be formed as a concave surface when viewed from the top or may have various other geometries without departing from the scope of the invention. When the closure body 600 is in the fully closed position (FIG. 32), the closure body orifice-defining surface 611 creates a high pressure seal with the fitment sealing surface 712.

Figure 38:
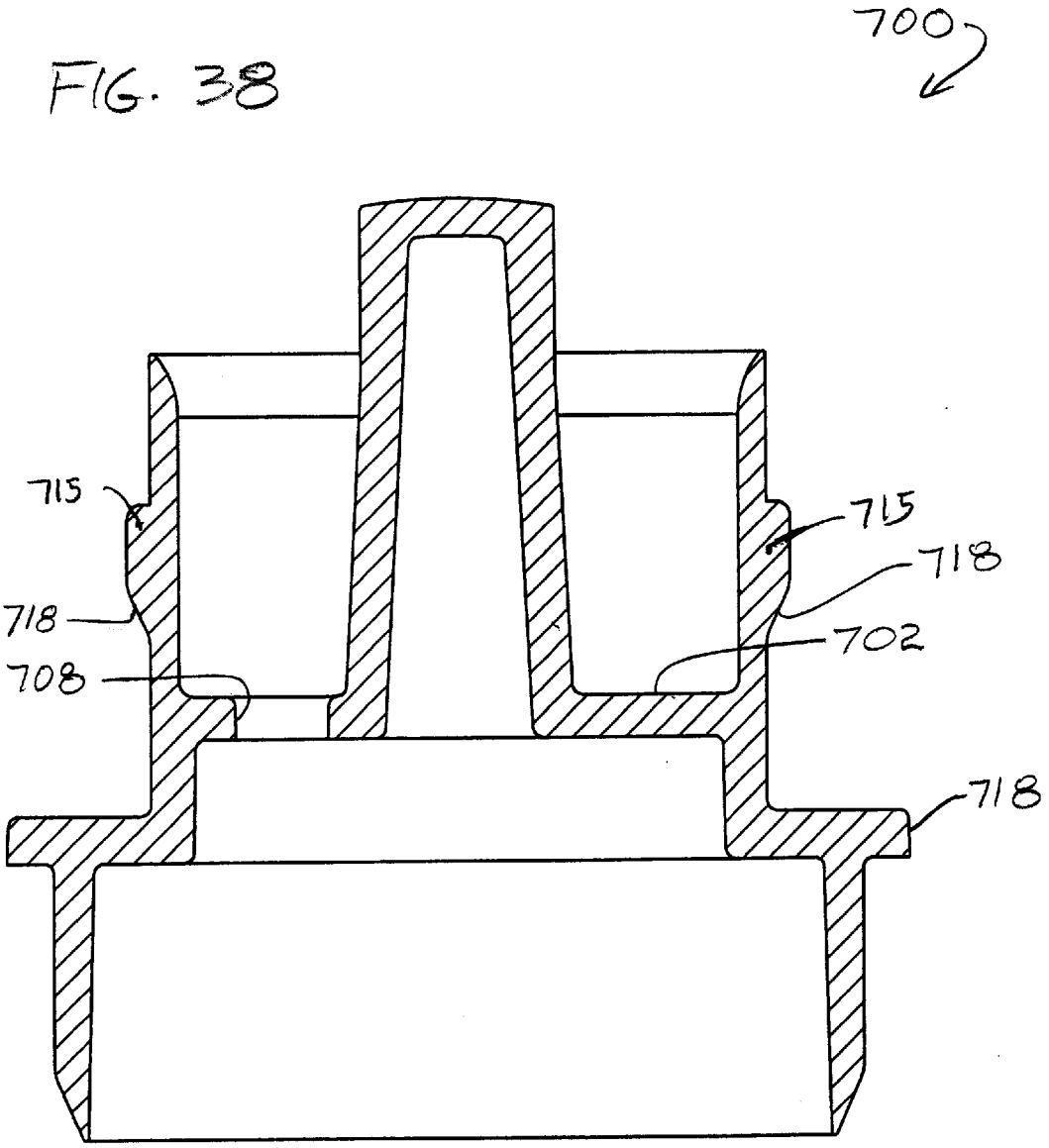
FIG. 38 is a cross-sectional view taken generally along the plane 38—38 in FIG. 35.

As best shown in FIGS. 35 and 38, in accordance with another feature of the invention, fitment sealing collar 704 includes at least one, and preferably two, projections, tabs, or stop ribs 715 extending radially outwardly. In the preferred arrangement, the stop ribs 715 are 180 degrees apart. Each stop rib 715 has a tapered bottom surface 717 (FIG. 38).

Figure 39:
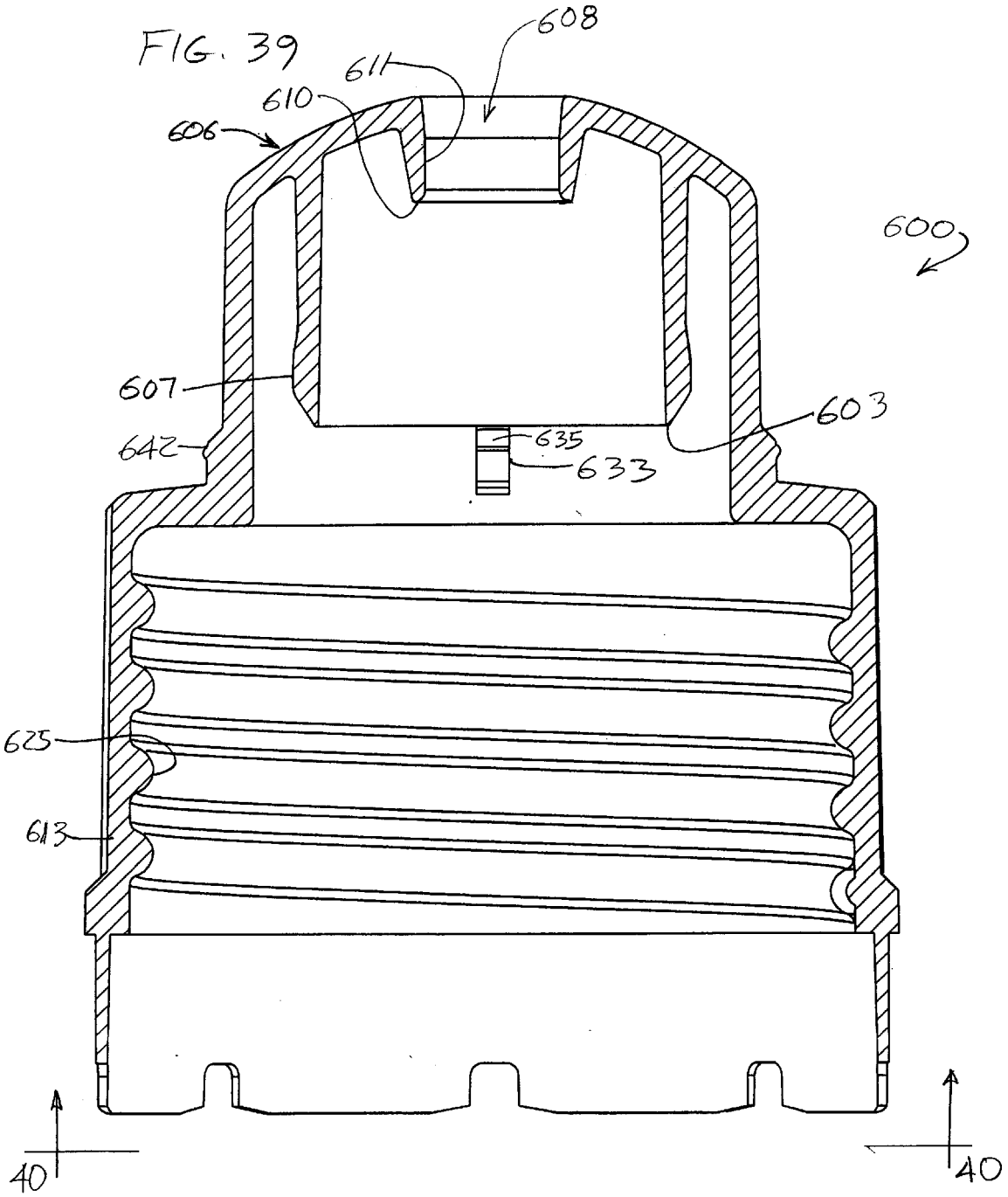
FIG. 39 is an enlarged, cross-sectional view taken generally along the plane 39—39 in FIG. 31.
Figure 40:
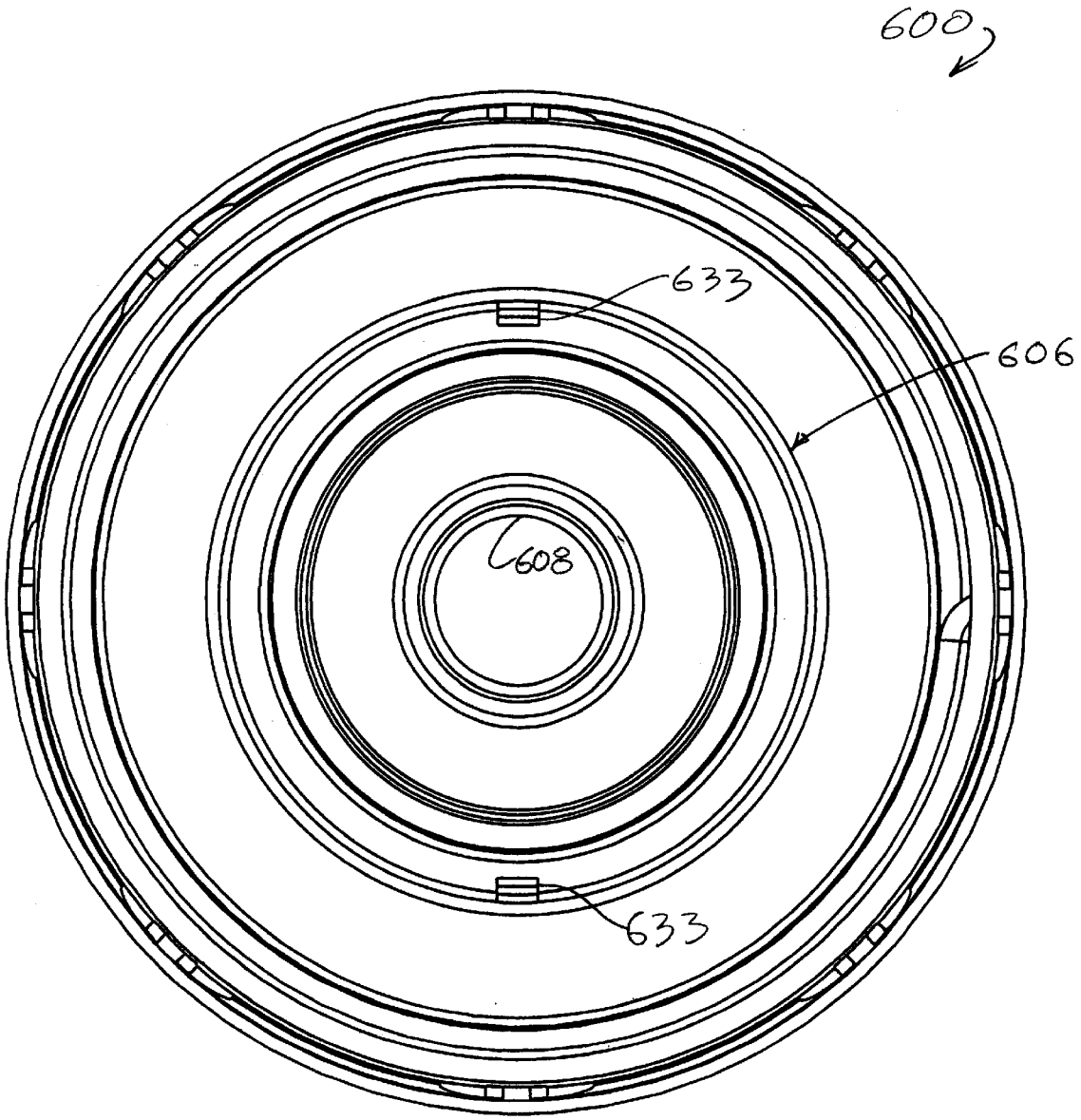
FIG. 40 is a bottom plan view of the closure body taken generally along the plane 40—40 in FIG. 39.

Referring to FIGS. 31, 39, and 40, in accordance with this preferred embodiment of the invention, the closure body 600 is provided with a structure that is somewhat similar to the first embodiment of the closure body 100 described above with respect to FIGS. 1–15. The closure body 600 includes a closure body skirt 613 (FIG. 39) having at least one female thread 625 formed on an interior thereof. FIGS. 31 and 39 show the closure body 600 in an initially as-molded condition—prior to forming an optional, turned up tamper band (i.e., drop ring) at the bottom of the skirt 610 which could be similar to the first embodiment tamper band shown in FIG. 11.

Figure 33:
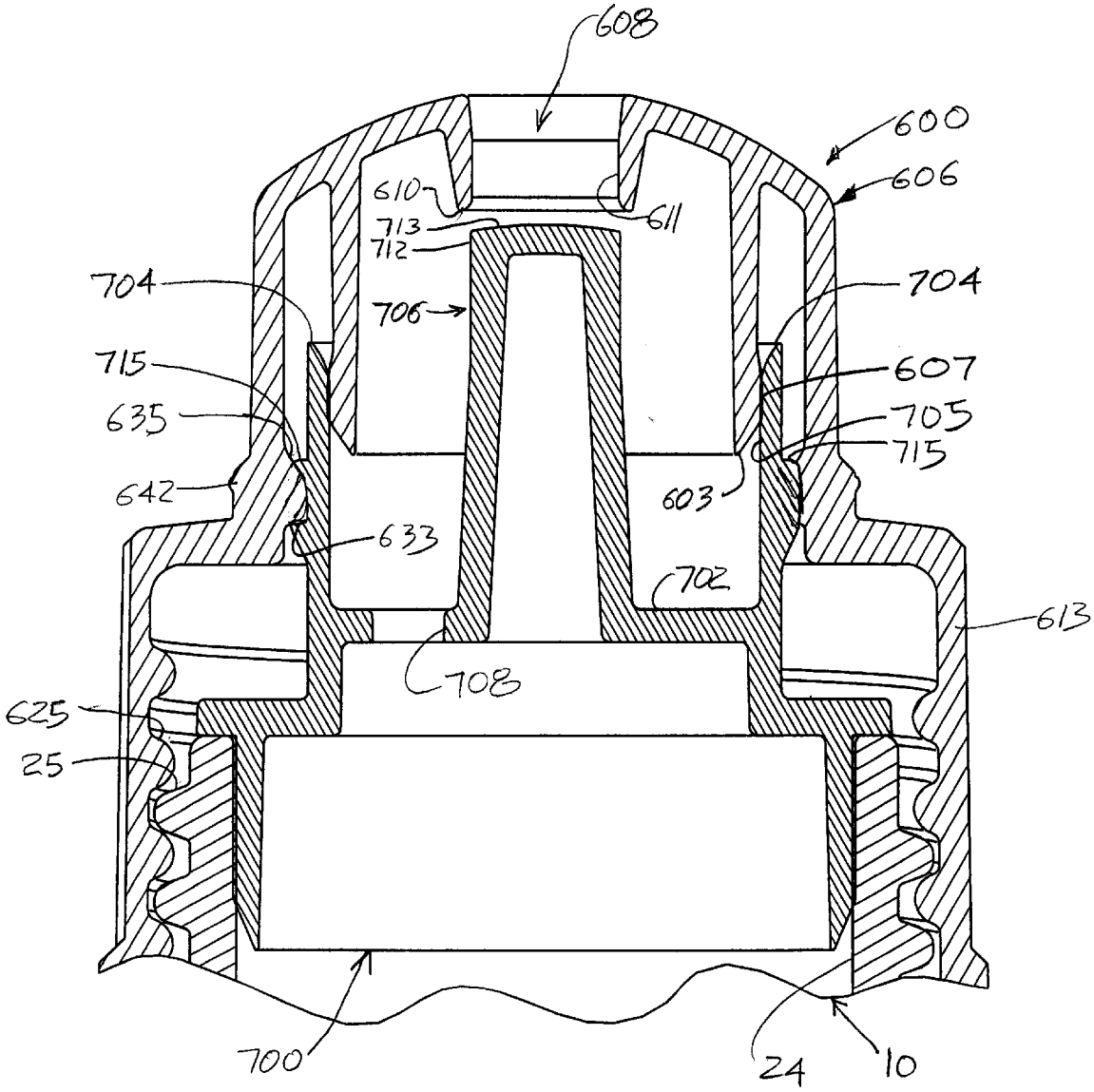
FIG. 33 is an enlarged, cross-sectional view of the dispensing closure assembly of FIG. 32 after installation on a container, but in an open, post-tamper position with the overcap removed.

The closure body 600 differs from the first embodiment closure body 100, however, in that the spout 606 of the closure body 600 includes an interior, annular sealing collar 603 which defines the exterior sealing surface 607 (FIG. 32) for sealingly and slidingly engaging the fitment sealing collar inner surface 705 (FIG. 33).

The closure body 600 also differs from the first embodiment closure body 100 in that the inside of the spout 606 includes at least one, and preferably two, projections in the form of stop tabs or stop lugs 633. As can be seen in FIG. 33, the upper end of each stop lug 633 has a tapered upper surface 635.

Assembly and operation of the closure assembly 650 according to this preferred embodiment of the present invention will now be described. The fitment 700 is disposed inside the closure body 600. The assembly process may require some relative rotation between the fitment 700 and body 600 if necessary so that the fitment ribs 715 and closure body lugs 633 are not in registry and so that the fitment ribs 715 can be located higher than the closure body lug stop lugs 633 (e.g., as shown in FIG. 32). The assembly of the fitment 700 and closure body 600 is then installed on the container 10 to create a container/fitment/body assembly by rotating the closure body 600 in a clockwise direction when viewed from above to cause the closure body thread 625 to engage the container thread 25 and to drive the fitment plug seal 710 into the container opening 22 so that the fitment flange 718 rests on the top of the container 22.

The closure body 600 is typically provided with a tamper-evident feature at its bottom edge which is secured to the container finish when the closure body 600 reaches its installed position shown in FIG. 32. To this end, the bottom of the closure body skirt 613 could be provided with frangible connections (not shown, but similar to connections 114 in the first embodiment described with reference to FIG. 12), and the bottom edge could be turned up prior to screwing the closure body 600 on the container 10, to form a break-away, tamper band similar to the first embodiment tamper band shown in FIG. 12.

Lastly, the cap 640 can be installed on the closure body 600. Alternatively, the cap 640 could be initially installed on the closure body 600, and then the cap 640, closure body 600, and fitment 700 disposed therein could be installed together as a unit on the container 10.

The bottom of the closure body spout 606 could have a retention bead 642 as shown in FIGS. 31, 33, and 39. The bottom of the closure cap 640 could have an internal, peripheral lip 644 (FIG. 32). This permits the closure cap 640 to be removably secured on the closure body 600 as shown in FIG. 32.

Once the closure assembly 650 has been initially assembled on the container 10, the closure assembly 650 may be opened (FIG. 33) and resealed (FIG. 32). As the closure body 600 is rotated from the fully closed position shown in FIG. 32, in a counterclockwise direction as viewed from above, it will rotated relative to the container 10 and fitment 700, and the closure body 600 will move upward relative to the container 10 and fitment 700 in an axial direction to the full open position shown in FIG. 33, thereby permitting flow through the fitment 700. If a lower tamper band (not visible in FIGS. 32 and 33) had been provided, it will break. The closure body orifice-defining surface 611 is preferably relatively long so as to maintain a seal against the post 706 for an amount of vertical travel of the closure body 600 relative to the container that is sufficient to break the frangible bridges of the tamper-evident drop ring. Only after the closure body 600 has moved vertically upwardly far enough to cause the drop ring to be completely broken away, does the surface 611 disengage from the post 706.

The fitment 700 and closure body 600 will function to provide a positive stop for a tactile sensation when the closure body 600 has been rotated to a fully open position. This is accomplished by the unique interaction of the closure body 600 with the fitment 700. The plug seal 710 and therefore the fitment 700 are frictionally engaged within the neck of the container 10 so that the fitment 700 resists rotation and axial movement relative to the container 10. When the closure body 600 has been rotated to the fully open position, the lateral sides of the closure body lugs 633 will engage the lateral sides of the fitment ribs 715 as shown in FIG. 33 to provide a positive stop and tactile sensation with respect to the fully open position of the closure 600.

The cap 640 may be removed to permit dispensing. The cap 640 may be replaced on the closure body 600 when the closure body 600 is in the open position to seal the closure assembly 650 without requiring movement of the closure body 600 down to the closed position.

If an attempt is made to rotate the closure body 600 in the opening direction beyond the initial engagement between the closure body stop lugs 633 and the fitment ribs 715, the fitment 700 will merely rotate within the opening 24 of the container 10 if the opening torque applied to the closure body 600 is of a sufficient magnitude to overcome the frictional engagement between the fitment 700 and the container 10. Thus, the fitment 700 will rotate but will not be forced out of the container 10. However, as the closure body 600 continues to rotate upwardly in the opening direction, the closure body stop lugs 633 will slide vertically along the fitment ribs 715. Eventually, the closure body 600 will be completely unscrewed from the container 10. The fitment 700 could then be manually grasped and pulled out of the container 10 to provide a completely unobstructed discharge opening in the container 10 and, hence, a higher capacity discharge system. If desired, the closure body 600 could be screwed back on to the container 10 without installing the fitment 700. This would allow a slightly greater flow rate than when the fitment 700 is in the container, but the cap 640 would have to be subsequently reinstalled on the closure body 600 if it is desired to prevent ingress of contaminants into the container or to prevent leakage out of the container should the container be inadvertently tipped over.

If product is dispensed from the container 10 with both the fitment 700 and closure body 600 removed, the system may be characterized as providing a maximum flow mode. If the fitment is removed from the container, but the closure body 600 is screwed back onto the container, the system may be characterized as providing an intermediate dispensing mode of somewhat greater flow rate than the first or initial dispensing mode which occurs when the fitment 700 is installed in the container 10 and the closure body 600 is installed on the container 10 over the fitment 700.

The embodiment of the invention illustrated in FIGS. 31–40 employs stop lugs 633 on the closure body 600 and stop ribs 715 on the fitment 700 to provide a positive rotation stop at the full open position of the closure body 600 (FIG. 33). It will be appreciated, however, that other engagement structures or features could be employed.

Further, if desired, engagement features could be provided on the closure body 600 and fitment 700 to facilitate removal of the fitment 700 from the container 10 upon further application of sufficient torque to the closure body 600 at the full open position.

For example, plug removal rib or ribs (not shown) could be provided in the form of a partially circular arc flange on the wall 704 of the fitment 700 above the ribs 715 for being engaged by the tops of the closure body stop lugs 633 when the closure body 600 is in the full open, elevated position. The removal flange on the fitment wall 704 would be located at an elevation relative to the stop lugs 633 on the closure body spout interior so that the closure body stop lugs 633 would engage the fitment plug removal flange when the closure body is unscrewed beyond the initial full open position and so that subsequent unscrewing of the closure body 600 would cause the closure body lugs 633 to exert an upward force on the fitment plug removal flange. Engagement of the partially circular arc plug removal flange on the fitment wall 704 would cause the fitment 700 to be pulled out of the container if the closure body 600 is unscrewed beyond the initial full open position. Other configurations of fitment removal ribs or flanges and cooperating closure lugs could be provided to effect removal of the fitment 700 from the container 10 as the closure body 600 is unthreaded from the container 10.

Although the closure assembly of the invention is exemplified by a threaded engagement with the container, the invention contemplates other fastening techniques and implements for securing the closure assembly to the container. For example, since the invention provides a closure assembly that obviates the need for relatively large sealing forces to be applied via threads on the closure assembly and container finish, threadless fastening of the closure assembly relative to the container is contemplated by the invention. Such fastening might incorporate a friction fit facilitated by a closure assembly having a skirt with an inside diameter sized to provide a sliding or telescoping engagement with a smooth, threadless container finish. In such an embodiment, the fitment and closure body would be provided with abutment surfaces, for example, a bayonet type interlock or fastening implement, which permit installation of the closure assembly on the container, but which may be configured, for example, by relative rotation of the closure body and container, to restrict upward movement of the closure body relative to the container.

It will be readily apparent from the foregoing detailed description of the invention and from the illustrations thereof that numerous other variations and modifications may be effected without departing from the true spirit and scope of the novel concepts or principles of this invention.

What is claimed is:

1. A fitment for use in a closure assembly that includes a closure body for mounting the closure assembly to a container to provide for the sealing of contents in the container under high-pressure, the fitment comprising:

a fitment deck;

a seal adapted to provide a high-pressure seal with the container;

an occluding portion adapted to occlude, and provide a high-pressure seal of, a dispensing orifice in a closure body; and at least one projection extending radially outwardly and adapted to be laterally engaged by a corresponding inwardly extending portion of a closure body as the closure body is rotated on the container neck relative to said fitment so as to provide a resistance to further rotation of said closure body independently of the orientation of the fitment relative to the container.

2. The fitment of claim 1 wherein the seal adapted to provide the high pressure seal with the container is a plug seal.

3. The fitment of claim 2, wherein the plug seal includes a sealing bead formed therein.

4. The fitment of claim 1, further comprising a deck; and an annular sealing collar extending from the fitment deck and adapted to engage an interior sealing surface of a spout formed on a closure body.

5. The fitment of claim 1, wherein the fitment has a deck that includes at least one aperture formed therein to permit passage of fluid through the fitment deck.

6. The fitment of claim 1, wherein the at least one projection is adapted to engage at least one radially inwardly projecting tab on the closure body.

7. The fitment of claim 1, wherein the at least one projection is shaped as a helical flange.

8. The fitment of claim 1 in which said projection is a stop rib, and further including the closure body in combination with the fitment wherein the closure body is threadingly mounted on the container and has a spout with an internal stop lug for engaging said fitment stop rib when said closure body is rotated to a predetermined open position.

9. A resealable dispensing closure assembly for sealing a container having contents under high-pressure, the closure assembly comprising:

a closure body having an outwardly extending spout and a dispensing orifice defined by a dispensing orifice peripheral sealing surface formed in the spout, the closure body being adapted to cooperate with a finish on the container to move from a first position to a second position, said dispensing orifice peripheral sealing surface defined by an inwardly extending sealing sleeve; and a fitment for engaging the container to provide a high-pressure seal therewith, the fitment including (1) at least one aperture for permitting flow from the container through the fitment and (2) a fitment sealing surface adapted to sealingly engage the dispensing orifice peripheral sealing surface of the closure body when the closure body is in the first position to prevent fluid flow through the dispensing orifice, whereby high-pressure fluid acts on one side of said sleeve to force said dispensing orifice peripheral sealing surface into tight sealing engagement with said fitment sealing surface.

10. The closure assembly of claim 9, wherein the closure body includes at least one thread for cooperating with at least one thread on the container finish.

11. The closure assembly of claim 9, wherein the fitment further comprises an annular sealing collar adapted to engage an interior surface of the spout.

12. The closure assembly of claim 9, wherein the fitment has a deck; and the fitment sealing surface is provided on a sealing post extending from the fitment deck.

13. The closure assembly of claim 9, further comprising a tamper-evident band adapted to provide evidence of movement of the closure body away from the first position.

14. A resealable dispensing closure assembly for providing at least two modes of dispensing fluid contents from a container, the closure assembly comprising:

a closure body having a spout and a dispensing orifice formed in the spout, the closure body being adapted to cooperate with a finish on the container; and a fitment for engaging the container to restrict fluid flow from the container, the fitment having at least one aperture for permitting flow from the container through the fitment, the fitment being removably attached to the container to permit the closure assembly to be configured into a first dispensing mode, in which flow of container contents occurs through the at least one aperture and the dispensing orifice, and a second dispensing mode in which the fitment is removed from the container and in which flow of container contents occurs through the dispensing orifice but not through the at least one aperture, said fitment including engagable means for being engaged by said closure body to lift said fitment out of the container, and said closure body including lifting means for engaging said engagable means on said fitment to lift said fitment out of the container.

15. The closure assembly of claim 14, wherein the fitment further includes a bead for snap-fit engagement with a groove defined in the container for removably attaching the fitment to the container.

16. The closure assembly of claim 14, wherein the fitment further includes a plug seal for sealingly engaging an interior surface of the container.

17. The closure assembly of claim 14, wherein said lifting means of the closure body includes at least one thread formed thereon for threadingly engaging a mating thread on said container to accommodate rotation of said closure body on said container so as to effect axial movement of said closure body relative to said container between a fully threadingly engaged condition and a disengaged condition, and the fitment engagable means comprises at least one projection adapted to be engaged by the at least one thread of the closure body to cause the fitment to be lifted and removed from the container as the closure body is rotated relative to the container and moves axially beyond the fully threadingly engaged condition toward the disengaged condition.

18. The closure assembly of claim 14, wherein the at least one aperture is adapted to provide a reduced flow in the first dispensing mode compared to the flow through the dispensing orifice in the second dispensing mode.

19. The closure assembly of claim 14, further comprising a tamper-evident band adapted to provide evidence of movement of the closure body relative to the container.

20. The closure assembly of claim 17, wherein the projection is a helical flange.

21. The closure assembly of claim 20 in which said helical flange terminates in a flat end;

said closure body has at least two thread turns for threadingly engaging a thread on said container; and said closure body includes a lug between two adjacent thread turns for engaging said helical flange flat end when said closure body is rotated in an unscrewing direction.

22. The closure assembly of claim 14 wherein said closure body includes a thread for threadingly mounting to said container;

said fitment includes a radially outwardly extending stop rib; and said closure body includes a radially inwardly extending stop lug for engaging said stop rib when said closure body is rotated on said container to a predetermined open position relative to said fitment.

23. A resealable dispensing closure assembly providing multiple seals for a container, the closure assembly comprising:

a closure body having (1) a closure skirt with at least one closure thread and adapted to cooperate with a thread on the container, (2) an outwardly extending spout, and (3) a dispensing orifice defined by a dispensing orifice peripheral sealing surface formed in the spout, said spout including a dynamic sealing surface spaced radially from said dispensing orifice peripheral sealing surface; and a fitment for sealingly engaging the container and the closure body, the fitment including (1) a seal adapted to form a first high-pressure seal with the container, (2) a sealing post that includes a sealing surface adapted to form a second high-pressure seal with the dispensing orifice peripheral sealing surface in the closure body spout, and (3) an annular sealing collar disposed around the sealing post for forming a third high-pressure seal with the spout dynamic sealing surface; and a lid on said closure body, said lid having a spud for forming a fourth seal with the closure body spout at the dispensing orifice.

24. The resealable dispensing closure assembly of claim 23, wherein the closure body lid further comprises an annular spout-engaging collar for forming a fifth seal with an exterior surface of the spout.

25. The resealable dispensing closure assembly of claim 24, wherein the closure body further comprises a peripheral shoulder and wherein the closure body lid further comprises a lid skirt, the lid skirt adapted to form a sixth seal with the peripheral shoulder.

26. A resealable dispensing closure assembly for providing at least two modes of dispensing fluid contents from a container, the closure assembly comprising:

a closure body having a spout and a dispensing orifice formed in the spout, the closure body including at least one thread formed thereon for threadingly engaging a mating thread on said container to accommodate rotation of said closure body on said container so as to effect axial movement of said closure body relative to said container between a fully threadingly engaged condition and a disengaged condition; and a fitment for engaging the container to restrict fluid flow from the container, the fitment having at least one aperture for permitting flow from the container through the fitment, the fitment being removably attached to the container to permit the closure assembly to be configured into a first dispensing mode, in which flow of container contents occurs through the at least one aperture and the dispensing orifice, and a second dispensing mode in which the fitment is removed from the container and in which flow of container contents occurs through the dispensing orifice but not through the at least one aperture, said fitment having at least one projection adapted to be engaged by the at least one thread of said closure body to cause the fitment to be lifted and removed from the container as the closure body is rotated relative to the container and moves axially beyond the fully threadingly engaged condition toward the disengaged condition.

27. A method of changing the dispensing mode of a closure assembly cooperating with a container, the closure assembly including a fitment having at least one aperture for permitting fluid flow through the fitment, the fitment adapted to cooperate with a closure body that is mounted on the container and that has a dispensing orifice defined by a dispensing orifice peripheral sealing surface for sealing against the fitment to occlude flow through the fitment when the closure body is in a lowered position and for accommodating flow through the fitment when the closure body is in an elevated position, the method comprising:

(a) removing the closure body from the container;

(b) removing the fitment from the container; and (c) replacing the closure body on the container without replacing the fitment, locating the closure body on the container at the lowered position or between the lowered and elevated positions, and subsequently dispensing contents through the dispensing orifice.

28. A method of resealing a closure assembly cooperating with a container wherein the closure assembly includes a fitment, closure body, and lid in which (1) the fitment is mounted on the container and has at least one aperture for permitting fluid flow from the container through the fitment, (2) the closure body (a) is mounted to the container to accommodate movement between open and closed positions over, and in cooperation with, the fitment, and (b) has at least one dispensing orifice which is occluded by the fitment when the closure body is in the closed position and which permits flow through the orifice when the closure body is in the open position, and (3) the lid is cooperatively associated with the closure body for accommodating movement between (a) a closed position occluding the dispensing orifice, and (b) an open position away from said dispensing orifice to permit the dispensing of contents of the container through the orifice, said method comprising:

(A) moving said closure body from the closed position in which said dispensing orifice is occluded by said fitment to the open position in which flow from the container through the dispensing orifice is permitted; and (B) moving said lid to the closed position to occlude said dispensing orifice while maintaining said closure body in the open position.

29. The method in accordance with claim 28 wherein the lid is hingedly attached to said closure body and step (B) includes pivoting said lid to the closed position.

30. The method in accordance with claim 28 further including the step, after step (A) and before step (B), of moving said lid to said open position and dispensing some contents from the container through said orifice.

* * * * *